US010241438B2

(12) United States Patent
Abe et al.

(10) Patent No.: US 10,241,438 B2
(45) Date of Patent: Mar. 26, 2019

(54) DEVELOPING DEVICE HAVING A DEVELOPING UNIT THAT IS PIVOTALLY SUPPORTED ABOUT THE AXIS OF A SHAFT, AND IMAGE FORMING APPARATUS

(71) Applicant: CANON KABUSHIKI KAISHA, Tokyo (JP)

(72) Inventors: Tsukasa Abe, Yokohama (JP); Masato Tanabe, Susono (JP); Tatsuro Harada, Mishima (JP); Kazutaka Sueshige, Susono (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/463,357

(22) Filed: Mar. 20, 2017

(65) Prior Publication Data

US 2017/0277071 A1 Sep. 28, 2017

(30) Foreign Application Priority Data

Mar. 22, 2016 (JP) ..... 2016-056987
Feb. 22, 2017 (JP) ..... 2017-031355

(51) Int. Cl.
*G03G 15/08* (2006.01)
*G03G 21/18* (2006.01)

(52) U.S. Cl.
CPC ..... *G03G 15/0813* (2013.01); *G03G 21/1825* (2013.01)

(58) Field of Classification Search
CPC ..... G03G 15/0813
USPC ..... 399/279
See application file for complete search history.

(56) References Cited

U.S. PATENT DOCUMENTS

| | | | | |
|---|---|---|---|---|
| 6,356,730 | B1 | 3/2002 | Nonaka | |
| 2005/0191089 | A1 | 9/2005 | Nishimura | |
| 2006/0039717 | A1 | 2/2006 | Hatori | |
| 2013/0243476 | A1* | 9/2013 | Sato | G03G 21/1623 399/110 |
| 2015/0253723 | A1* | 9/2015 | Morioka | G03G 21/1676 399/111 |

FOREIGN PATENT DOCUMENTS

| | | | |
|---|---|---|---|
| EP | 2933690 | A1 | 10/2015 |
| JP | H07-072675 | A | 3/1995 |
| JP | 9-230694 | A | 9/1997 |
| JP | 2013-182036 | A | 9/2013 |
| JP | 2014-55991 | A | 3/2014 |
| JP | 2015-169876 | A | 9/2015 |

* cited by examiner

*Primary Examiner* — Walter L Lindsay, Jr.
*Assistant Examiner* — Philipmarcus T Fadul
(74) *Attorney, Agent, or Firm* — Canon USA, Inc., IP Division

(57) ABSTRACT

A developing device includes a developing unit including a developer bearing member and a developing frame member configured to support the developer bearing member. The developing unit is supported to be pivotable about a first shaft and a second shaft. A biasing member configured to bias the first shaft is provided.

23 Claims, 23 Drawing Sheets

DEVELOPING DEVICE HAVING A DEVELOPING UNIT THAT IS PIVOTALLY SUPPORTED ABOUT THE AXIS OF A SHAFT, AND IMAGE FORMING APPARATUS

BACKGROUND OF THE INVENTION

Field of the Invention

The present invention relates to an image forming apparatus using an electrophotographic image forming system (an electrophotographic process) and a developing device used in an image forming apparatus.

The image forming apparatus forms an image on a recording material (a recording medium) using the electrophotographic process. Examples of the image forming apparatus include a printer (a laser beam printer or a light-emitting diode (LED) printer), a copying machine, a facsimile apparatus, a word processor, and a multifunction peripheral (a multifunction printer) including these apparatuses.

Further, the developing device is a device for developing, using a developer, an electrostatic latent image formed on an electrophotographic photosensitive drum (hereinafter referred to as a "photosensitive member") as an image bearing member. The developing device includes a developing unit, a developing frame member for supporting the developing unit, and components related to the developing unit. Examples of the developing unit include a developing roller as a developer bearing member and a developing blade as a developer regulating member.

Description of the Related Art

The image forming apparatus, such as a printer, using the electrophotographic process uniformly charges the photosensitive member. Then, the image forming apparatus selectively exposes the charged photosensitive member to form an electrostatic latent image on the photosensitive member. Then, using toner as a developer, the image forming apparatus visualizes as a toner image the electrostatic latent image formed on the photosensitive member. Then, the image forming apparatus transfers the toner image formed on the photosensitive member onto a recording material, such as a recording sheet and a plastic sheet, and applies heat and pressure to the toner image transferred onto the recording material to fix the toner image to the recording material, so that the image is recorded.

Generally, such an image forming apparatus requires maintenance of various process units used for the electrophotographic process. Examples of the process units include a charging unit for acting on a photosensitive member, a developing unit, and a cleaning unit. To facilitate maintenance of these various process units, a method for integrating the photosensitive member, the charging unit, the developing unit, and the cleaning unit into a cartridge to be attachable to and detachable from the main body of an image forming apparatus is put to practical use. According to this cartridge method, it is possible to provide an image forming apparatus excellent in usability.

The configuration of a cartridge, a drum cartridge including a photosensitive drum, a developing cartridge as a developing device including a developing unit, and a toner cartridge for supplying a developer, are known.

As discussed in the publication of Japanese Patent Application Laid-Open No. 2013-182036, there is a developing cartridge including a developing unit pivotably supporting a developing roller, and a frame pivotably supporting both end portions of the developing unit. In such a configuration, the frame is positioned relative to the main body of an image forming apparatus so that the developing unit can pivot, and the developing roller can abut a photosensitive drum and be separate from the photosensitive drum.

SUMMARY OF THE INVENTION

In the configuration in which a developing unit pivots, and a developing roller as a developer bearing member abuts a photosensitive drum as an image bearing member, there is a case where a shift in a position of a pivotal center of the developing unit has an influence on stability of the abutment of the developing roller to the photosensitive drum.

According to an aspect of the present invention, a developing unit including a developer bearing member and a developing frame member configured to support the developer bearing member, an end supporting member configured to pivotably support the developing unit on one end side in an axis direction of the developer bearing member, an other-end supporting member configured to pivotably support the developing unit on the other end side in the axis direction, a first shaft provided in the developing unit, a second shaft provided in either one of the developing unit and the other-end supporting member, a first hole provided in the end supporting member, the first hole being configured to support the first shaft so that the developing unit pivots about the first shaft and the second shaft and also being configured to allow the first shaft to move in a direction intersecting the axis direction, a second hole provided in the other of the developing unit and the other-end supporting member, the second hole being configured to support the second shaft so that the developing unit pivots about the first shaft and the second shaft and also being configured to restrain the second shaft from moving in the direction intersecting the axis direction, and a biasing member configured to bias the first shaft in the direction intersecting the axis direction.

Further features of the present invention will become apparent from the following description of exemplary embodiments with reference to the attached drawings.

DESCRIPTION OF THE EMBODIMENTS (Overall Configuration of Image Forming Apparatus)

Figure 2:
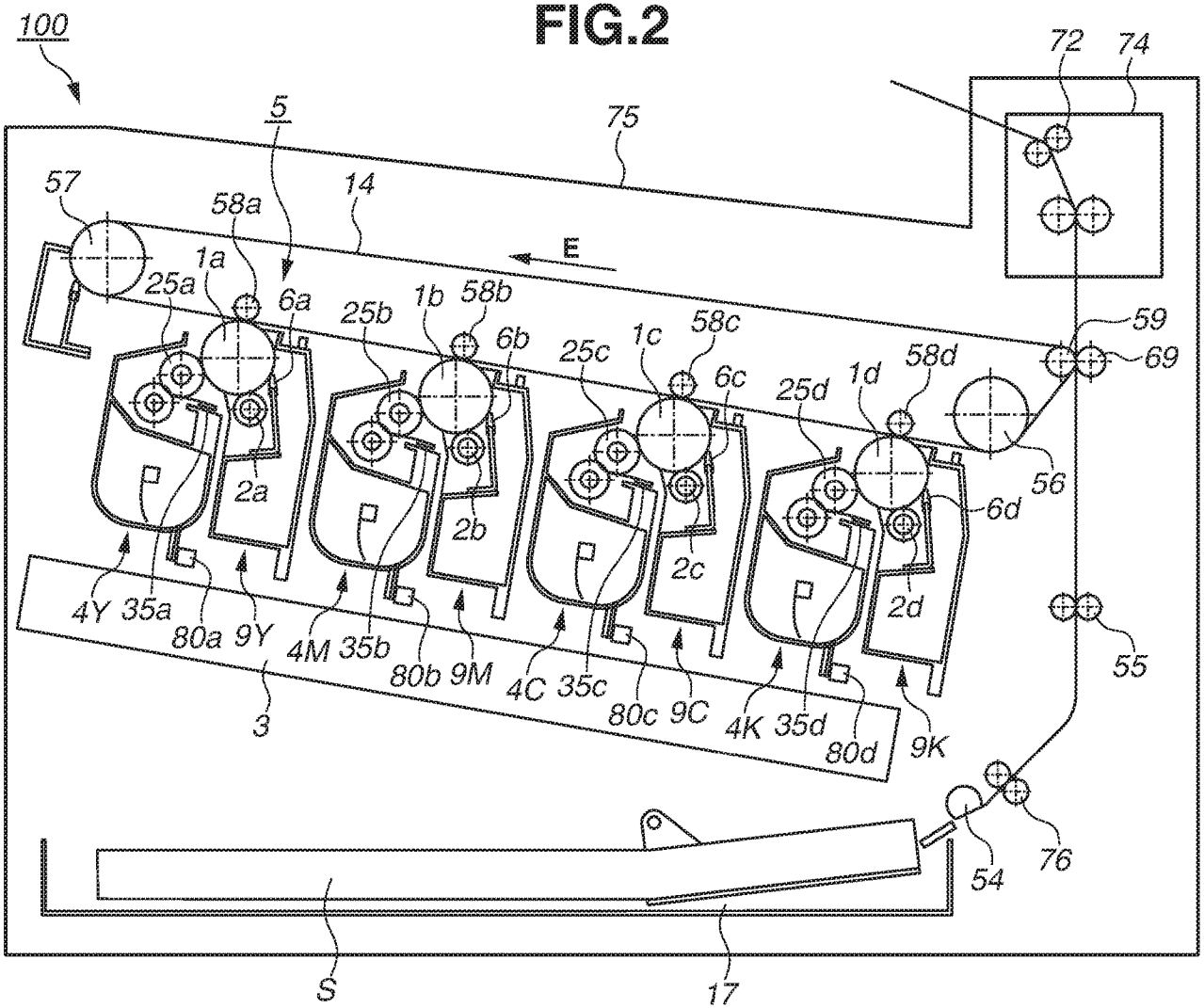
FIG. 2 is a schematic diagram of an electrophotographic image forming apparatus according to the first exemplary embodiment.

First, with reference to FIG. 2, the overall configuration of an apparatus main body 100 of an electrophotographic image forming apparatus (hereinafter referred to as an "image forming apparatus") is described. As illustrated in FIG. 2, to the apparatus main body 100, four photosensitive drum cartridges (hereinafter referred to as "drum cartridges") 9 (9Y, 9M, 9C, 9K) are attached, which include photosensitive drums as image bearing members and are attachable to and detachable from the apparatus main body 100. Further, to the apparatus main body 100, four developing devices (hereinafter referred to as "developing cartridges") 4 (4Y, 4M, 4C, 4K) are attached. The drum cartridges 9 and the developing cartridges 4 are detachably attached to the apparatus main body 100 by attachment members (not illustrated). Further, the drum cartridges 9 and the developing cartridges 4 are provided side by side in the apparatus main body 100 so as to be inclined with respect to the horizontal direction.

Each drum cartridge 9 includes a photosensitive drum 1 (1*a*, 1*b*, 1*c*, 1*d*). Around the photosensitive drum 1, process units, such as a charging roller 2 (2*a*, 2*b*, 2*c*, 2*d*) as a charging member and a cleaning member 6 (6*a*, 6*b*, 6*c*, 6*d*) as a cleaning member are placed in an integrated manner.

Each developing cartridge 4 (4Y, 4M, 4C, 4K) includes a developing roller 25 (25*a*, 25*b*, 25*c*, 25*d*) as a developer bearing member. Process units, such as a developing blade 35 (35*a*, 35*b*, 35*c*, 35*d*) as a developer regulating member are placed in an integrated manner.

The charging roller 2 uniformly charges the surface of the photosensitive drum 1. The developing roller 25 abuts the photosensitive drum 1 and develops an electrostatic latent image formed on the photosensitive drum 1, using a developer (hereinafter referred to as "toner"), so that the electrostatic latent image is visualized as a toner image. Then, the cleaning member 6 removes the toner remaining on the photosensitive drum 1 after the toner image formed on the photosensitive drum 1 is transferred onto a recording medium S.

Further, below the drum cartridges 9 and the developing cartridges 4 in the apparatus main body 100, a scanner unit 3 is provided, which is an exposure device for selectively exposing the photosensitive drums 1 based on image information, to form electrostatic latent images on the photosensitive drums 1.

To a lower portion of the apparatus main body 100, a cassette 17, which stores recording media S, is attached. Then, a recording medium conveying unit is provided to convey the recording media S to an upper portion of the apparatus main body 100 through a secondary transfer roller 69 and a fixing unit 74. That is, a feed roller 54, a conveying roller pair 76, and a registration roller pair 55 are provided. The feed roller 54 separates the recording media S in the cassette 17 and feeds the recording media S one by one. The conveying roller pair 76 conveys the fed recording medium S. The registration roller pair 55 synchronizes the recording medium S with electrostatic latent images formed on the photosensitive drums 1.

Further, above the drum cartridges 9 and the developing cartridges 4, an intermediate transfer unit 5 is provided as an intermediate transfer means for transferring toner images formed on the respective photosensitive drums 1 (1*a*, 1*b*, 1*c*, 1*d*). The intermediate transfer unit 5 includes a driving roller 56, a driven roller 57, primary transfer rollers 58 (58*a*, 58*b*, 58*c*, 58*d*) at positions opposed to the photosensitive drums 1 of the respective colors, and an opposed roller 59 at a position opposed to the secondary transfer roller 69. A transfer belt 14 as an intermediate transfer member is stretched around these rollers. The transfer belt 14 circularly moves in the direction of arrow E so as to be opposed to and in contact with all the photosensitive drums 1. Voltage is applied to the primary transfer rollers 58 (58*a*, 58*b*, 58*c*, 58*d*), so that the toner images are primarily transferred from the photosensitive drums 1 onto the transfer belt 14. Then, voltage is applied to the opposed roller 59, which is placed within the transfer belt 14, and the secondary transfer roller 69, so that the toner on the transfer belt 14 is transferred onto a recording medium S.

In image formation, the photosensitive drums 1 are rotated, and the scanner unit 3 selectively exposes the photosensitive drums 1 uniformly charged by the charging rollers 2. Consequently, electrostatic latent images are formed on the photosensitive drums 1 and developed by the developing rollers 25. Toner images of the respective colors are thus formed on the photosensitive drums 1. In synchronization with this image formation, the registration roller pair 55 convey a recording medium S to a secondary transfer position where the opposed roller 59 and the secondary transfer roller 69 abut each other through the transfer belt 14. Then, transfer bias voltage is applied to the secondary transfer roller 69, so that the toner images of the respective colors on the transfer belt 14 are secondarily transferred onto the recording medium S. A color image is thus formed on the recording medium S. The recording medium S on which the color image is formed is heated and pressurized by the fixing unit 74, so that the toner image is fixed. Then, the recording medium S is discharged to a discharge portion 75 by discharge rollers 72. The fixing unit 74 is provided in an upper portion of the apparatus main body 100.

Further, below each developing cartridge 4, a unit biasing members 80 (80*a*, 80*b*, 80*c*, 80*d*) are provided in the apparatus main body 100 to cause the developing roller 25, which is held in the developing cartridge 4, to abut the photosensitive drum 1.

(Drum Cartridge)

Figure 3:
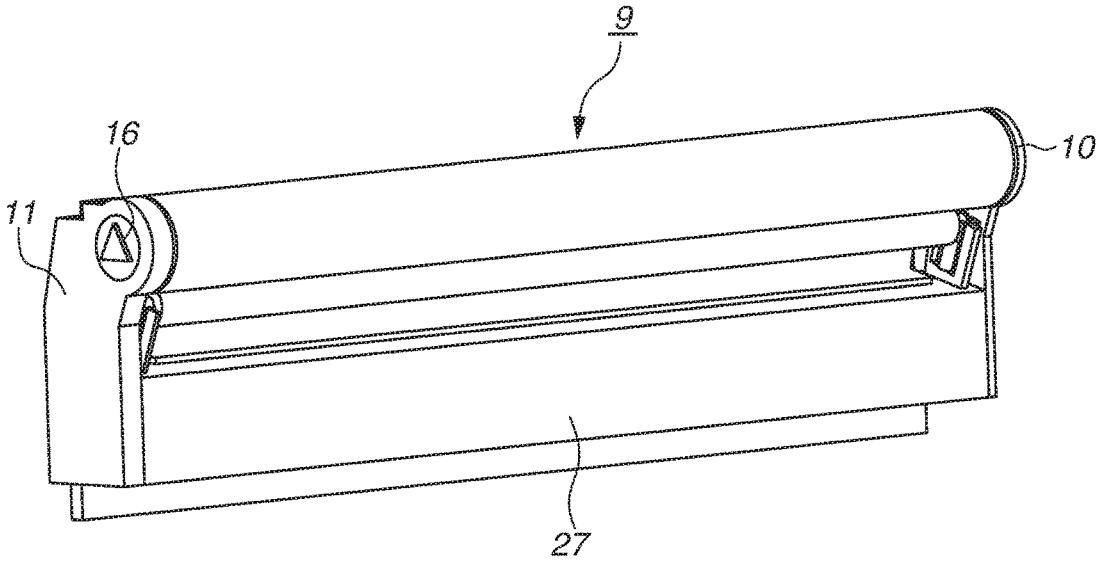
FIG. 3 is a diagram illustrating a drum cartridge according to the first exemplary embodiment.
Figure 4:
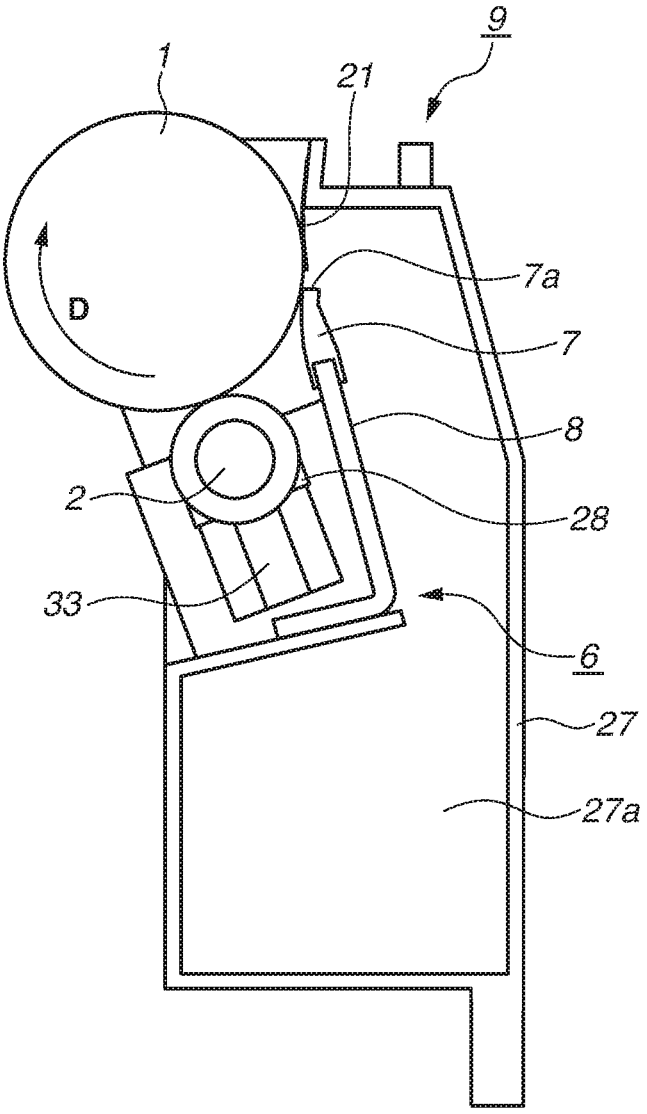
FIG. 4 is a cross-sectional view illustrating the drum cartridge according to the first exemplary embodiment.

Next, with reference to FIGS. 3 and 4, a drum cartridge 9 according to a first exemplary embodiment is described. FIG. 3 is a diagram illustrating the configuration of the drum cartridge 9 (9Y, 9M, 9C, 9K). In the present exemplary embodiment, the drum cartridges 9Y, 9M, 9C, and 9K have the same configuration. In the following description, the upstream side in the insertion direction of the drum cartridge 9 and the developing cartridge 4 is defined as a near side, and the downstream side in the insertion direction of the drum cartridge 9 and the developing cartridge 4 is defined as a far side.

In a cleaning frame member 27 of the drum cartridge 9 (9Y, 9M, 9C, 9K), a photosensitive drum 1 is rotatably provided through a drum front bearing 10 and a drum rear bearing 11. On one end side in the axis direction of the photosensitive drum 1, a drum coupling 16 and a flange are provided.

FIG. 4 is a cross-sectional view of the drum cartridge 9. Around the photosensitive drum 1, which rotates in the direction of arrow D in FIG. 4, the charging roller 2 and the cleaning member 6 are provided as described above. The cleaning member 6 includes a rubber blade 7 and a cleaning supporting member 8. An extremity portion 7*a* of the rubber blade 7 is disposed to abut the photosensitive drum 1 in a direction counter to the rotational direction of the photosensitive drum 1. Residual toner removed from the surface of the photosensitive drum 1 by the cleaning member 6 falls into a removed toner chamber 27*a*. Further, a sealing sheet 21, which prevents removed toner in the removed toner chamber 27*a* from leaking, abuts the photosensitive drum 1. The driving force of a main body driving motor, which is a driving source (not illustrated), is transmitted to the drum coupling 16 of the drum cartridge 9, thereby driving the photosensitive drum 1 to rotate according to an image forming operation. The charging roller 2 is rotatably attached to the drum cartridge 9 through a charging roller bearing 28. The charging roller 2 is urged (or pressurized) toward the photosensitive drum 1 by a charging roller urging (pressure) member 33 and driven to rotate by the photosensitive drum 1.

(Developing Cartridge)

Figure 5:
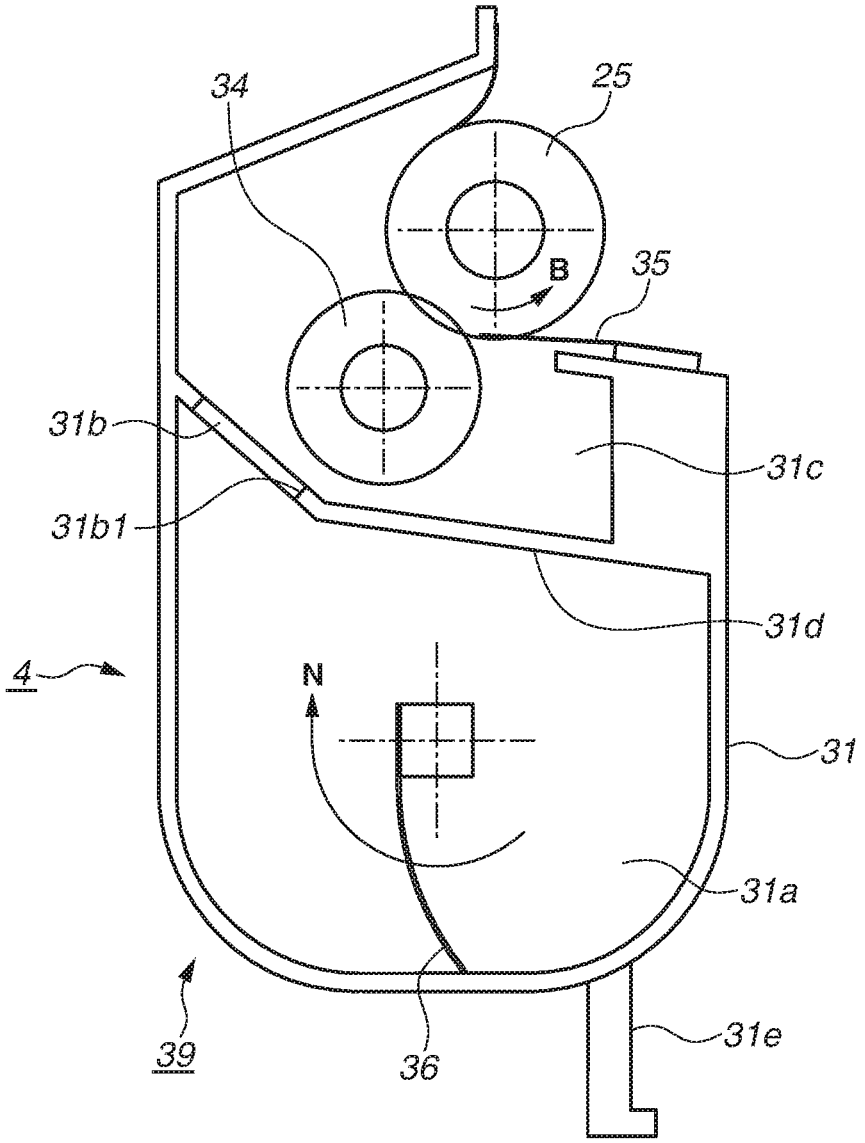
FIG. 5 is a cross-sectional view illustrating the developing device according to the first exemplary embodiment.

Next, with reference to FIG. 5, a developing cartridge 4 is described. FIG. 5 is a cross-sectional view of the developing cartridge 4 (4Y, 4M, 4C, 4K), which stores toner. In the present exemplary embodiment, the developing cartridge 4Y, which stores yellow toner, the developing cartridge 4M, which stores magenta toner, the developing cartridge 4C, which stores cyan toner, and the developing cartridge 4K, which stores black toner, have the same configuration. A part of the configuration of each developing cartridge 4 may be different.

The developing cartridge 4 includes a developing unit 39, which includes the developing roller 25 and a developing frame member 31. The developing frame member 31 rotatably supports the developing roller 25, which rotates in the direction of arrow B in contact with the photosensitive drum 1. Further, the developing frame member 31 includes a toner supply roller 34, which rotates in contact with the developing roller 25, and a developing blade 35, which regulates a toner layer on the developing roller 25. The developing frame member 31 includes a developing chamber 31*c*, in which the developing roller 25 is placed, and a toner storage chamber 31*a*, which is provided below the developing chamber 31*c*. The developing chamber 31*c* and the toner storage chamber 31*a* are partitioned by a partition wall 31*d*. Further, in the partition wall 31*d*, an opening 31*b* is provided so that when toner is conveyed from the toner storage chamber 31*a* to the developing chamber 31*c*, the toner passes through the opening 31*b*. Further, in the developing frame member 31, a biased portion 31*e* is provided, which is biased by the unit biasing member 80 (80*a*, 80*b*, 80*c*, 80*d*) (see FIG. 2) of the apparatus main body 100.

Figure 7:
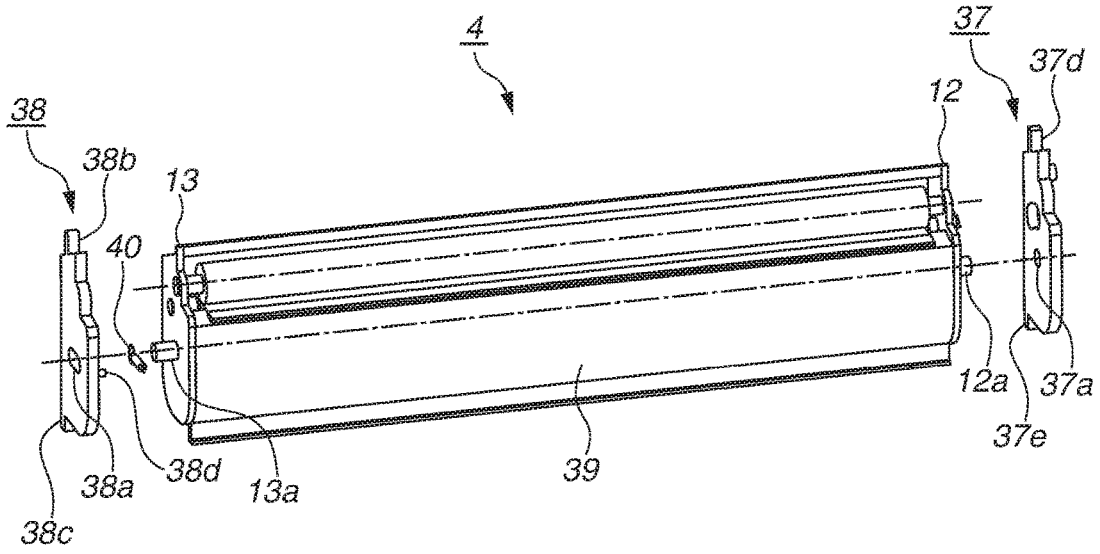
FIG. 7 is a diagram illustrating the developing device according to the first exemplary embodiment.

The developing roller 25 and the toner supply roller 34 are rotatably supported by the developing frame member 31 through a developing unit rear bearing 12 and a developing unit front bearing 13, which are provided on both sides in the axis direction of the developing roller 25 (see FIG. 7).

In the toner storage chamber 31*a* of the developing frame member 31, a toner conveying member 36 is provided, which rotates in the direction of arrow N in FIG. 5 to agitate toner stored in the toner storage chamber 31*a* and also convey the toner to the developing chamber 31*c* through the opening 31*b*.

In the developing cartridge 4 according to the present exemplary embodiment, when an image is formed, the rotation center of the toner conveying member 36 is located further on the lower side in the direction of gravity than an opening lower side portion 31*b*1, which is on the lower side in the direction of gravity of the opening 31*b*, and the center of the developing roller 25 is located further on the upper side in the direction of gravity than the opening lower side portion 31*b*1. The toner conveying member 36 scoops up toner from the toner storage chamber 31*a*, which is provided below the developing chamber 31*c*. The toner conveying member 36 supplies the toner to the developing chamber 31*c*.

(Configuration for Inserting Drum Cartridge and Developing Cartridge into Electrophotographic Image Forming Apparatus)

Figure 6:
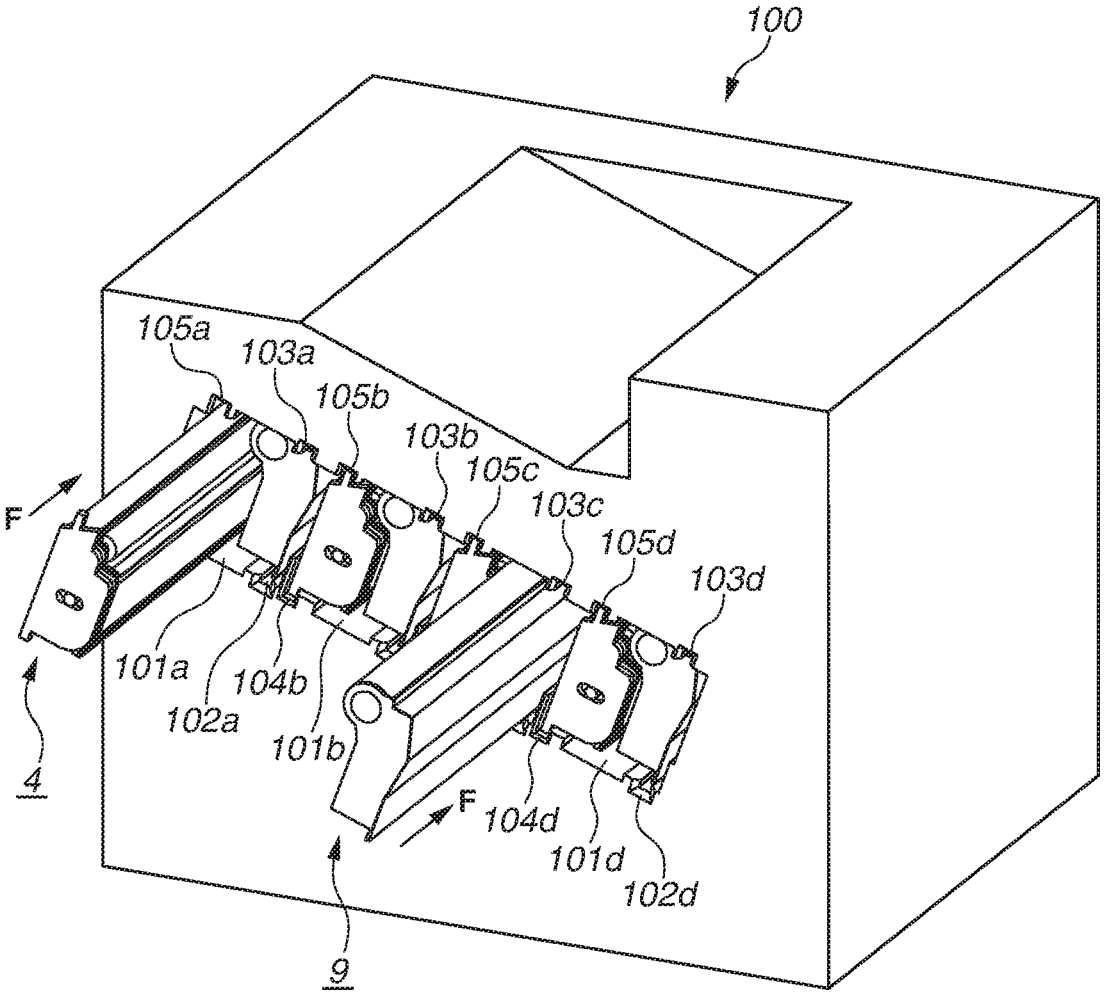
FIG. 6 is a diagram illustrating the attachment of the drum cartridge and the developing device according to the first exemplary embodiment.

Next, with reference to FIG. 6, the configuration for inserting the drum cartridge 9 and the developing cartridge 4 into the apparatus main body 100 is described. In the apparatus main body 100, an attachment opening 101 (101*a*, 101*b*, 101*c*, 101*d*) is provided, to which each drum cartridge 9 and each developing cartridge 4 are attached. In the present exemplary embodiment, the drum cartridge 9 is attached to and detached from the attachment opening 101 such that the attachment/detachment direction of the drum cartridge 9 is the axis direction of the photosensitive drum 1. Further, the developing cartridge 4 is attached to and detached from the attachment opening 101 such that the attachment/detachment direction of the developing cartridge 4 is the axis direction of the developing roller 25. That is, the drum cartridge 9 and the developing cartridge 4 are configured to be inserted from the near side to the far side. In the following description, this direction is referred to as an "insertion direction F". Further, as illustrated in FIG. 6, the drum cartridge 9 and the developing cartridge 4 are each independently attachable to and detachable from the apparatus main body 100. That is, the developing cartridge 4 is attachable to and detachable from the apparatus main body 100 including the photosensitive drum 1 on which a latent image is to be developed by the developing roller 25. Further, the developing cartridge 4 is attachable to and detachable from the apparatus main body 100 in the state where the drum cartridge 9 including the photosensitive drum 1 on which a latent image is to be developed by the developing roller 25 is attached to the apparatus main body 100.

On the upper side of the apparatus main body 100, a drum cartridge upper guide portion 103 (103*a*, 103*b*, 103*c*, 103*d*), which is a third main body guide portion, is provided. On the lower side of the apparatus main body 100, a drum cartridge lower guide portion 102 (102*a*, 102*b*, 102*c*, 102*d*), which is a fourth main body guide portion, is provided. The drum cartridge upper guide portion 103 and the drum cartridge lower guide portion 102 each extend along the insertion direction F of the drum cartridge 9.

Further, on the upper side of the apparatus main body 100, a developing cartridge upper guide portion 105 (105*a*, 105*b*, 105*c*, 105*d*), which is a first main body guide portion, is provided. On the lower side of the apparatus main body 100, a developing cartridge lower guide portion 104 (104*a*, 104*b*, 104*c*, 104*d*), which is a second main body guide portion, is provided. The developing cartridge upper guide portion 105 and the developing cartridge lower guide portion 104 each extend along the insertion direction F of the developing cartridge 4.

When the drum cartridge 9 is inserted, the drum cartridge 9 is placed on the near side, in the attachment direction, of the drum cartridge lower guide portion 102 and the drum cartridge upper guide portion 103. Then, the drum cartridge 9 is moved in the insertion direction F along the drum cartridge upper guide portion 103 and the drum cartridge lower guide portion 102, to be inserted into the apparatus main body 100.

The developing cartridge 4 is inserted similarly to the drum cartridge 9. The developing cartridge 4 is placed on the near side, in the attachment direction, of the developing cartridge upper guide portion 105 and the developing cartridge lower guide portion 104. Then, the developing cartridge 4 is moved in the insertion direction F along the developing cartridge upper guide portion 105 and the developing cartridge lower guide portion 104, to be inserted into the apparatus main body 100.

(Details of Configuration of Developing Cartridge)

Next, with reference to FIGS. 1A, 1B, 7, 8A, 8B, and 9, the details of the configuration of the developing cartridge 4 according to the first exemplary embodiment of the present invention are described.

As illustrated in FIG. 7, in the present exemplary embodiment, an end supporting member (first end supporting member) 38 is provided, which pivotably supports an end portion of the developing unit 39 on one end side in the axis direction of the developing roller 25. On the other hand, an other-end supporting member (second end supporting member) 37 is provided, which pivotably supports an end portion of the developing unit 39 on the other end side in the axis direction of the developing roller 25 (an end portion on the opposite side of the end portion for which the end supporting member 38 is provided). That is, the end supporting member 38 and the other-end supporting member 37 are provided on both end sides of the developing unit 39 with the developing unit 39 placed between the end supporting member 38 and the other-end supporting member 37.

In the other-end supporting member 37, a second hole 37*a* is provided as a positioning hole for pivotably supporting the developing unit 39 and regulating the position of the developing unit 39 in a direction intersecting the axis of the developing roller 25. Further, in the end supporting member 38, a first hole 38*a* is provided as a supporting hole for pivotably supporting the developing unit 39 and supporting the developing unit 39 in a manner such that the developing unit 39 is movable in the direction intersecting (desirably a direction orthogonal to) the axis of the developing roller 25.

Further, in the developing unit 39, a boss 13*a* (which corresponds to a first shaft) is provided as a supporting shaft pivotably supported by the first hole 38*a*. In contrast to the boss 13*a* of the developing unit 39, on the other end side in the axis direction of the developing roller 25, a boss 12*a* (which corresponds to a second shaft) is provided as a positioning shaft pivotably supported by the second hole 37*a*. The bosses 12*a* and 13*a* have cylindrical shapes. In the present exemplary embodiment, the bosses 12*a* and 13*a* are concentric with each other and provided parallel to the axis of the developing roller 25.

As illustrated in FIG. 7, the first hole 38*a* and the boss 13*a* are engaged with each other, and the second hole 37*a* and the boss 12*a* are engaged with each other. Then, the end supporting member 38 and the other-end supporting member 37 are pivotable relative to the developing unit 39 about the boss 13*a* and the boss 12*a* pivotably supported by the first hole 38*a* and the second hole 37*a*, respectively. Further, the end supporting member 38 and the other-end supporting member 37 are each independently movable (pivotable) relative to the developing unit 39. That is, the end supporting member 38 is configured to support the end portion of the developing unit 39 on one end side in the axis direction of the developing roller 25 and configured not to support the end portion of the developing unit 39 on the other end side in the axis direction of the developing roller 25. Conversely, the other-end supporting member 37 is configured to support the end portion of the developing unit 39 on the other end side in the axis direction of the developing roller 25 and configured not to support the end portion of the developing unit 39 on one end side in the axis direction of the developing roller 25. That is, the other-end supporting member 37 is pivotable relative to the developing unit 39 and the end supporting member 38. The end supporting member 38 is pivotable relative to the developing unit 39 and the other-end supporting member 37. In other words, when the other-end supporting member 37 pivots relative to the developing unit 39, the end supporting member 38 can stop its movement relative to the developing unit 39 and the other-end supporting member 37. Further, when the end supporting member 38 pivots relative to the developing unit 39, the other-end supporting member 37 can stop its movement relative to the developing unit 39 and the end supporting member 38.

The second hole 37*a* has a circular hole shape. That is, the boss 12*a* is a positioning portion pivotably supported by the second hole 37*a* and restrained from moving in the direction intersecting the axis of the developing roller 25.

Figure 8A:
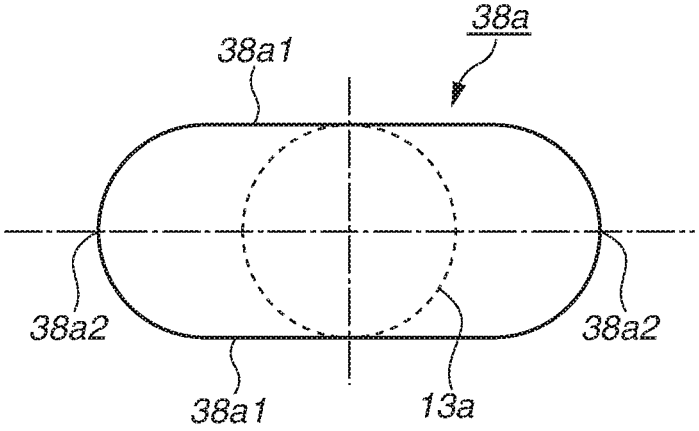
FIGS. 8A and 8B are diagrams illustrating a supporting hole according to the first exemplary embodiment.
Figure 8B:
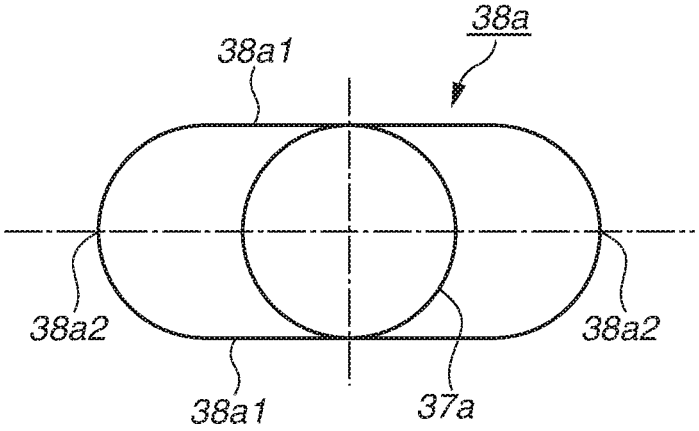

On the other hand, as illustrated in FIGS. 8A and 8B, the first hole 38*a* pivotably supports the boss 13*a* and is formed into a long hole to enable the boss 13*a* to move in a direction intersecting the axis of the developing roller 25. That is, the first hole 38*a* is a long hole having a first regulation portion 38*a*1, which regulates the diameter direction of the boss 13*a*, and a second regulation portion 38*a*2, which intersects the first regulation portion 38*a*1 and is larger than the first regulation portion 38*a*1. As described above, the first hole 38*a* is a long hole and thereby can absorb the influence of the shifting of the axis of the developing roller 25 and the centers of the bosses 13*a* and 12*a* due to a dimensional tolerance and the like. In the present exemplary embodiment, the first hole 38*a* has a long circular hole shape. The hole shape of the first hole 38*a*, however, is not limited to a long circular hole. Alternatively, the hole shape of the first hole 38*a* may be an angular hole.

Figure 15A:
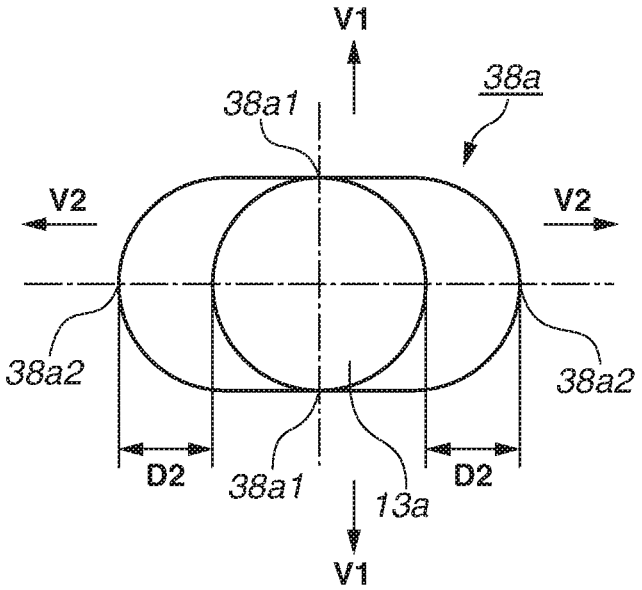
FIGS. 15A and 15B are diagrams illustrating a first hole and a second hole.
Figure 15B:
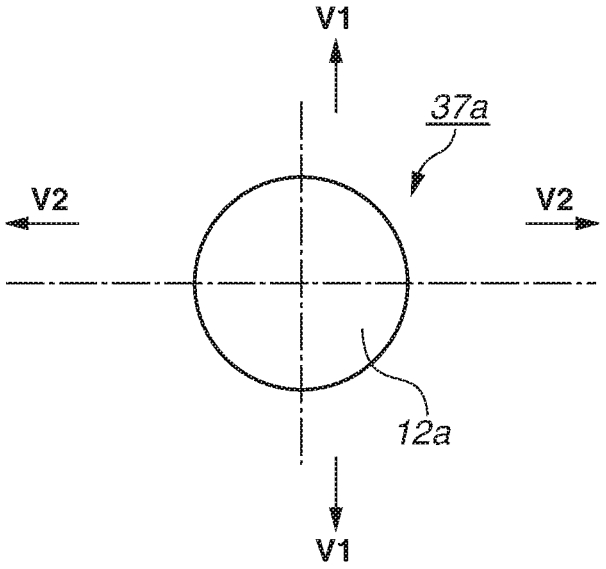
Figure 16A:
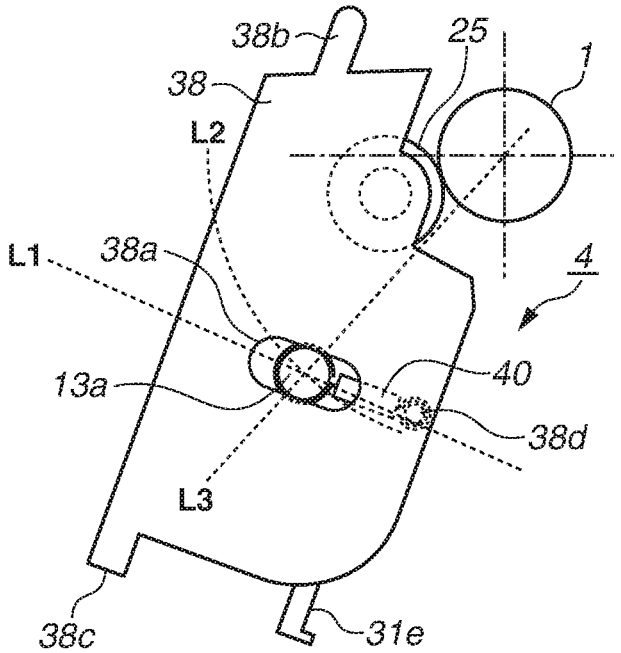
FIGS. 16A and 16B are diagrams illustrating a configuration of the first hole.
Figure 16B:
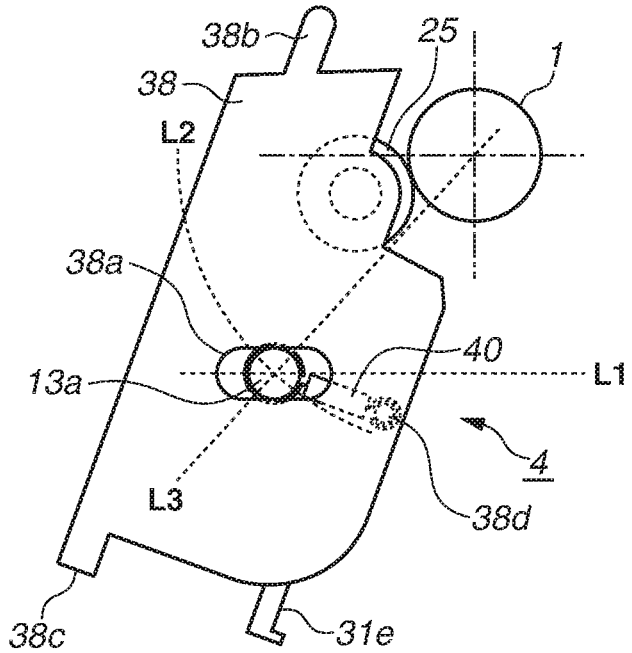

With reference to FIGS. 15A and 15B, the first hole 38*a* and the second hole 37*a* are further described. FIG. 15A is a diagram illustrating the state where the first hole 38*a* and the boss 13*a* are engaged with each other, and FIG. 15B is a diagram illustrating the state where the second hole 37*a* and the boss 12*a* are engaged with each other, each diagram viewed from the axis direction of the developing roller 25. The direction in which the boss 13*a* is restrained by the first regulation portion 38*a*1 of the first hole 38*a* from moving in a direction intersecting (desirably orthogonal to) the axis of the developing roller 25 is defined as a first direction V1. A direction intersecting (desirably orthogonal to) the axis of the developing roller 25 and also orthogonal to the first direction V1 (a direction toward the second regulation portion 38*a*2) is defined as a second direction V2. The first hole 38*a*, which is a long hole, allows the boss 13*a* to move in the second direction V2. On the other hand, the second hole 37*a*, which is a circular hole, restrains the boss 12*a* from moving in the first direction V1 and the second direction V2. At least in the second direction V2, a distance D2 by which the boss 13*a* can move in the first hole 38*a* is longer than the distance by which the boss 12*a* can move in the second hole 37*a*. With reference to FIGS. 16A and 16B, the first hole 38*a* is further described. FIGS. 16A and 16B are diagrams illustrating the configuration of the first hole 38*a* according to the present exemplary embodiment. FIGS. 16A and 16B illustrate the developing cartridge 4 when viewed from the axis direction of the developing roller 25 in the state where the developing cartridge 4 is attached to the image forming apparatus.

As illustrated in FIG. 16A, the direction in which the first hole 38*a* according to the present exemplary embodiment allows the boss 13*a* to move (the direction in which the boss 13*a* can move in the first hole 38*a*) is defined as L1. Further, a circle having the same center as the center of the photosensitive drum 1 and passing through the center of the first hole 38*a* is defined as L2. Then, a line connecting the center of the photosensitive drum 1 and the center of the first hole 38*a* is defined as L3. In this state, L1 intersects L2. Further, L1 is inclined with respect to L3. The direction of L1 is not limited to a direction as illustrated in FIG. 16A. For example, the configuration can also be such that as illustrated in FIG. 16B, L1 is the horizontal direction in the state where the developing cartridge 4 is attached to the image forming apparatus.

As described above, the first hole 38*a* and the boss 13*a* are engaged with each other, and the second hole 37*a* and the boss 12*a* are engaged with each other. The first hole 38*a* allows the boss 13*a* to move in a direction intersecting the axis direction of the developing roller 25. Consequently, the developing unit 39 is pivotably supported by the end supporting member 38 and allowed to move in the direction intersecting the axis direction of the developing roller 25. The second hole 37*a* restrains the boss 12*a* from moving in the direction intersecting the axis direction of the developing roller 25. Consequently, the developing unit 39 is pivotably supported by the other-end supporting member 37 and restrained from moving in the direction intersecting the axis direction of the developing roller 25. Thus, the developing unit 39 pivots about the boss 12*a* and the boss 13*a* relative to the end supporting member 38 and the other-end supporting member 37, respectively.

Figure 9:
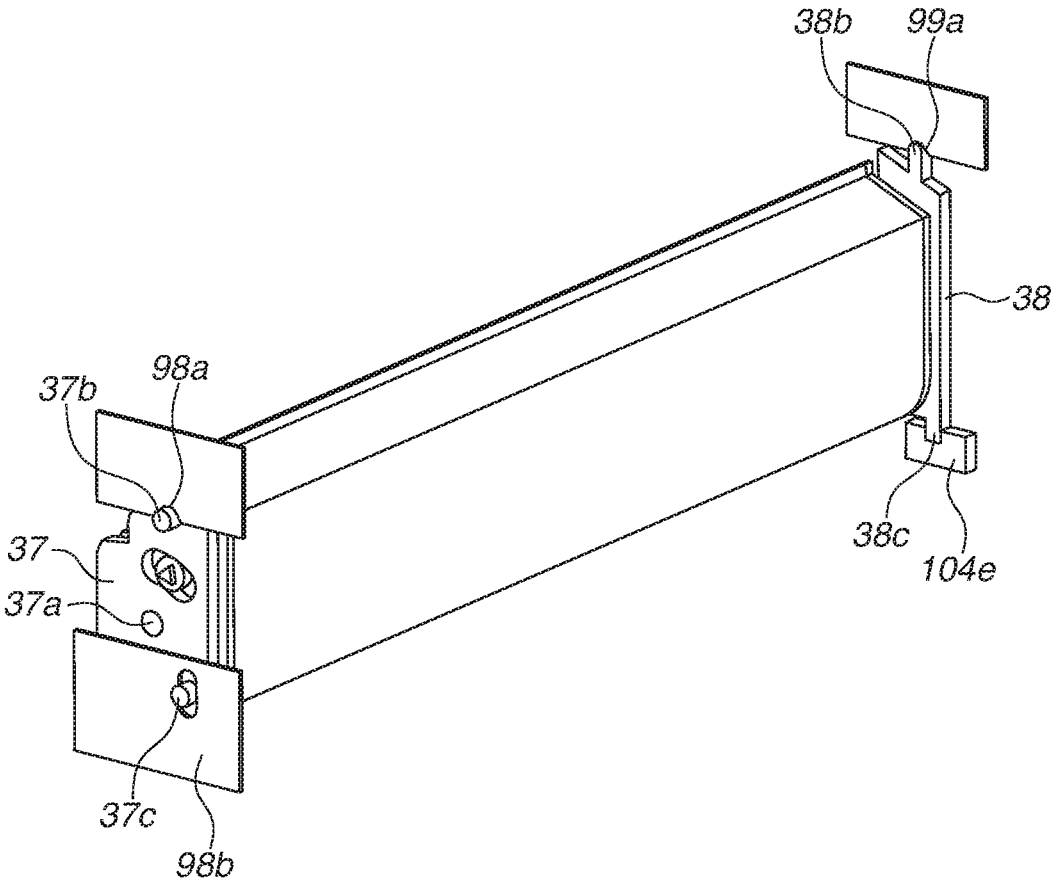
FIG. 9 is a diagram illustrating a state where the developing device according to the first exemplary embodiment is positioned relative to a main body of the image forming apparatus.

Next, as illustrated in FIG. 9, in the other-end supporting member 37, a third engaged portion 37*b* and a fourth engaged portion 37*c* are provided. After the insertion of the developing cartridge 4 into the apparatus main body 100 is completed, the third engaged portion 37*b* and the fourth engaged portion 37*c* are engaged with a third main body engagement portion 98*a* and a fourth main body engagement portion 98*b*, respectively, which are provided in the apparatus main body 100. Consequently, the other-end supporting member 37 is positioned relative to the apparatus main body 100. Further, in the other-end supporting member 37, a third guided portion 37*d* and a fourth guided portion 37*e* are provided, which are guided by the developing cartridge upper guide portion 105 and the developing cartridge lower guide portion 104, respectively, when the developing cartridge 4 is attached (see FIG. 7).

Further, in the end supporting member 38, a first engaged portion 38*b* and a second engaged portion 38*c* are provided. After the insertion of the developing cartridge 4 into the apparatus main body 100 is completed, the first engaged portion 38*b* and the second engaged portion 38*c* are engaged with a first main body engagement portion 99*a* and a second main body engagement portion 104*e*, respectively, which are provided in the apparatus main body 100. Consequently, the end supporting member 38 is positioned relative to the apparatus main body 100.

In the present exemplary embodiment, the second main body engagement portion 104*e* and the developing cartridge lower guide portion 104 are the same component. Further, the first engaged portion 38*b* and the second engaged portion 38*c* function also as a first guided portion and a second guided portion which are portions guided by the developing cartridge upper guide portion 105 and the developing cartridge lower guide portion 104, respectively.

In the state where the end supporting member 38 and the other-end supporting member 37 are positioned relative to the image forming apparatus, the second hole 37*a* and the first hole 38*a* are provided in a direction intersecting the axis of the developing roller 25 and overlap each other. That is, the first hole 38*a* and the second hole 37*a* are placed to overlap each other when viewed from the axis direction of the developing roller 25. In the present exemplary embodiment, the center of the first hole 38*a* coincides with the center of the second hole 37*a* (see FIG. 8). Meanwhile, as described above, in the present exemplary embodiment, the bosses 12*a* and 13*a* are concentric with each other and provided parallel to the axis of the developing roller 25. That is, in the state where the end supporting member 38 and the other-end supporting member 37 are positioned relative to the image forming apparatus, and when the boss 13*a* is located at the center of the first hole 38*a*, the axis of the developing roller 25 is parallel to the axis of the photosensitive drum 1.

Figure 1A:
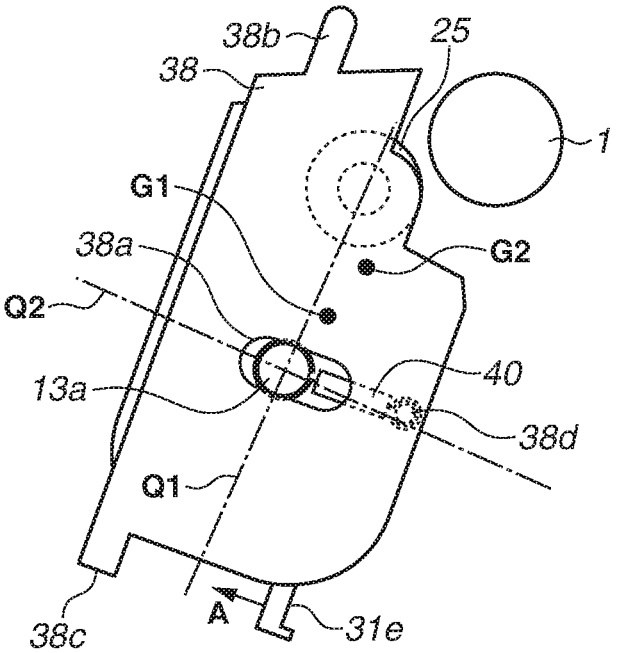
FIG. 1A is a diagram illustrating a developing device according to a first exemplary embodiment when a shift in alignment occurs in a developing unit.
Figure 1B:
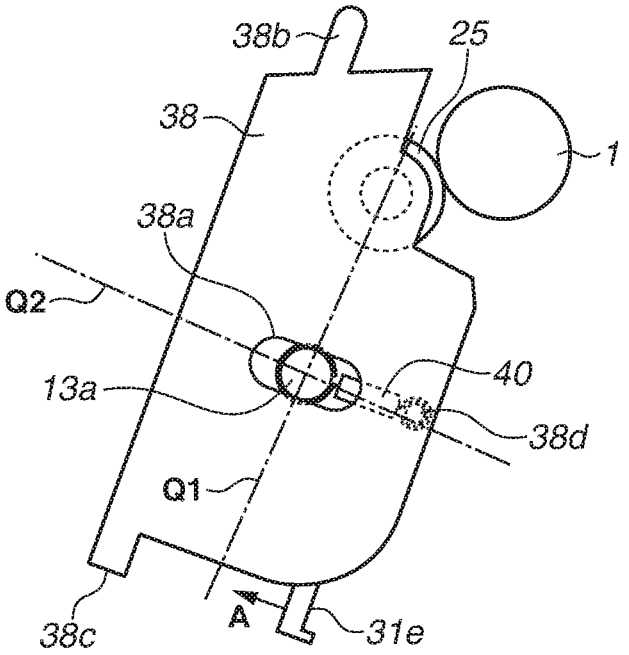
FIG. 1B is a diagram illustrating the developing device when the developing unit is located at a normal position.

As illustrated in FIGS. 1A and 1B, in the state where the other-end supporting member 37 and the end supporting member 38 are each positioned relative to the apparatus main body 100, the bosses 12*a* and 13*a* both form the pivotal centers of the developing unit 39. The developing unit 39 pivots about the bosses 12*a* and 13*a*, so that the developing roller 25 abuts the photosensitive drum 1. In the present exemplary embodiment, the boss 12*a*, the boss 13*a*, the second hole 37*a*, and the first hole 38*a* are provided at positions where moments are generated by the weight of the developing unit 39 itself in the direction in which the developing roller 25 abuts the photosensitive drum 1.

As described above, when an image is formed, the developing roller 25 of the developing cartridge 4 abuts the photosensitive drum 1 and visualizes the image. In the present exemplary embodiment, the biased portion 31*e* (which corresponds to a force reception portion) of the developing frame member 31 is biased in a developing unit biasing direction A by the unit biasing member 80 (which corresponds to a force imparting portion) of the apparatus main body 100 (see FIG. 2), so that the developing roller 25 abuts the photosensitive drum 1. That is, the biased portion 31*e* is provided so that when the biased portion 31*e* is biased by the unit biasing member 80, the developing roller 25 moves in the direction in which the developing roller 25 abuts the photosensitive drum 1.

Figure 17:
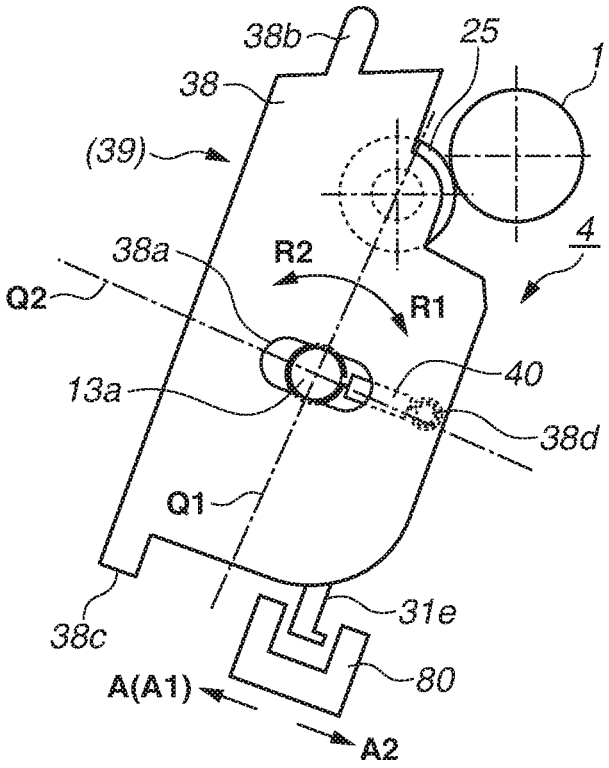
FIG. 17 is a diagram illustrating a unit biasing member.

FIG. 17 illustrates the structure of the unit biasing member 80. FIG. 17 is a diagram illustrating the developing cartridge 4 as viewed from the axis direction of the developing roller 25. On the far side of the plane of the paper, the developing unit 39 is located. On the near side of the plane of the paper, the end supporting member 38 is located. The biased portion 31*e* of the developing frame member 31 is biased by the unit biasing member 80 in a developing unit biasing direction A1 (the same as the direction A). As a result, the developing unit 39 pivots in a direction R1, and the developing roller 25 abuts the photosensitive drum 1. Further, when the biased portion 31*e* of the developing frame member 31 is biased by the unit biasing member 80 in a direction A2, which is a direction opposite to the developing unit biasing direction A1, the developing unit pivots in a direction R2 and the developing roller 25 separates from the photosensitive drum 1.

In the present exemplary embodiment, the biased portion 31*e* is placed such that the distance from the center of the developing roller 25 to the biased portion 31*e* is longer than the distance from the center of the developing roller 25 to the center of the boss 13*a*. Further, in the present exemplary embodiment, when a straight line Q1 connecting the center of the developing roller 25 and the center of the boss 13*a* and a straight line Q2 orthogonal to the straight line Q1 are drawn through the center of the boss 13*a*, the biased portion 31*e* is placed in an area on the opposite side of the developing roller 25 with respect to the straight line Q2.

Figure 18A:
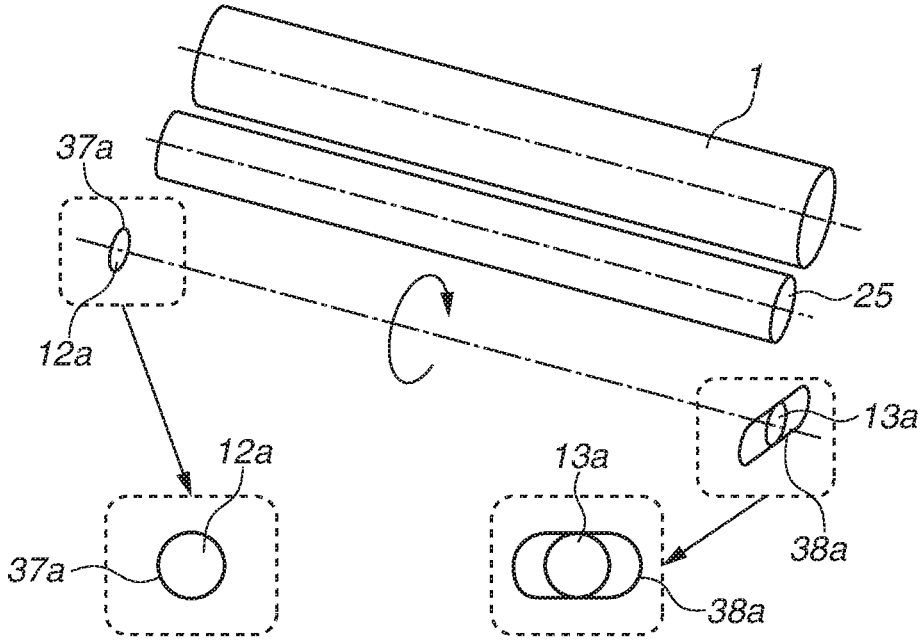
FIGS. 18A and 18B are schematic diagrams illustrating a shift in alignment.
Figure 18B:
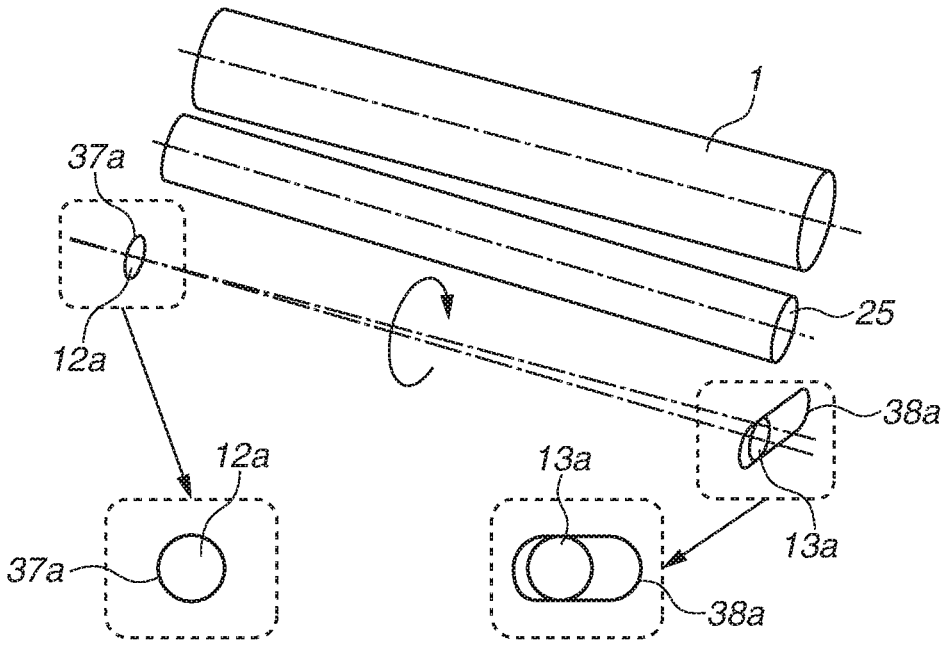

If the biased portion 31*e* is biased in the developing unit biasing direction A, the developing roller 25 is going to abut the photosensitive drum 1. In this process, in the first hole 38*a*, which is a long hole, the boss 13*a* moves in a direction away from the photosensitive drum 1 toward the second regulation portion 38*a*2. On the other hand, the boss 12*a* on the opposite side is restrained by the second hole 37*a*, which is a circular hole, from moving in a direction intersecting the axis of the developing roller 25. Thus, the boss 12*a* cannot move beyond a slight gap between the boss 12*a* and the second hole 37*a*. As a result, the developing cartridge 4 is in the state where the axis of the developing roller 25 is shifted from the axis of the photosensitive drum 1, i.e., the state where a shift in alignment occurs in the developing unit 39. Further, also if the position of the center of gravity of the developing unit 39 moves from G1 to G2 as a result of the consumption of toner in the developing unit 39, the developing cartridge 4 can be in a similar state. FIGS. 18A and 18B are schematic diagrams illustrating the shift in alignment described above. FIG. 18A illustrates the state where the axis of the developing roller 25 is substantially parallel to the axis of the photosensitive drum 1. FIG. 18B illustrates the state where the axis of the developing roller 25 is not parallel to the axis of the photosensitive drum 1, i.e., the state where a shift in alignment occurs. As illustrated in FIGS. 18A and 18B, the boss 13*a* is allowed to move in a direction away from the photosensitive drum 1 by the first hole 38*a*, which is a long hole. On the other hand, the boss 12*a* is restrained by the second hole 37*a*, which is a circular hole, from moving in a direction intersecting the axis of the developing roller 25. Thus, the developing cartridge 4 may be in the state where the axis of the developing roller 25 is not parallel to the axis of the photosensitive drum 1 (the state where a shift in alignment occurs). In this state where a shift in alignment occurs, the developing roller 25 may not be able to abut the photosensitive drum 1.

Meanwhile, the developing cartridge 4 according to the present exemplary embodiment includes a tension spring 40, which is an elastic member as a biasing portion or biasing member, in the end supporting member 38. Further, the end supporting member 38 includes a spring fixing boss 38*d*, which is an elastic member supporting portion for supporting the tension spring 40. One end of the tension spring 40 is supported by the spring fixing boss 38*d*, which is an elastic member supporting portion of the end supporting member 38, and the other end is supported by the boss 13*a*.

The tension spring (biasing member) 40 biases the boss 13*a* in a direction intersecting (desirably a direction orthogonal to) the axis of the developing roller 25. In this manner, as illustrated in FIG. 1B, the boss 13*a* is biased in a direction opposite to the developing unit biasing direction A. That is, the boss 13*a* is biased in the first hole 38*a* in the direction in which the center of the boss 13*a* approaches the center of the photosensitive drum 1 (the direction in which the distance between the center of the boss 13*a* and the center of the photosensitive drum 1 shortens). In the present exemplary embodiment, this direction is the direction in which the center of the boss 13*a* coincides with the center of the second hole 37*a*. As a result, the center of the boss 13*a* approaches the center of the photosensitive drum 1 so that the distance from the center of the boss 13*a* to the center of the photosensitive drum 1 is the same as the distance from the center of the boss 12*a* to the center of the photosensitive drum 1. That is, the difference between the distance from the center of the boss 13*a* to the center of the photosensitive drum 1 and the distance from the center of the boss 12*a* to the center of the photosensitive drum 1 is smaller than the case where the tension spring 40, which is a biasing portion, is not used. Thus, the axis of the developing roller 25 comes close to being parallel to the axis of the photosensitive drum 1. That is, the angle between the axis of the developing roller 25 and the axis of the photosensitive drum 1 is smaller than the case where the tension spring 40, which is a biasing portion, is not used. Thus, it is possible to stably cause the developing roller 25 to abut the photosensitive drum 1.

Although it is desirable that the distance from the center of the boss 13*a* to the center of the photosensitive drum 1 be the same as the distance from the center of the boss 12*a* to the center of the photosensitive drum 1, these distances do not need to be exactly the same. Further, although it is desirable that the axis of the developing roller 25 be parallel to the axis of the photosensitive drum 1, these axes do not need to be exactly parallel.

Figure 19:
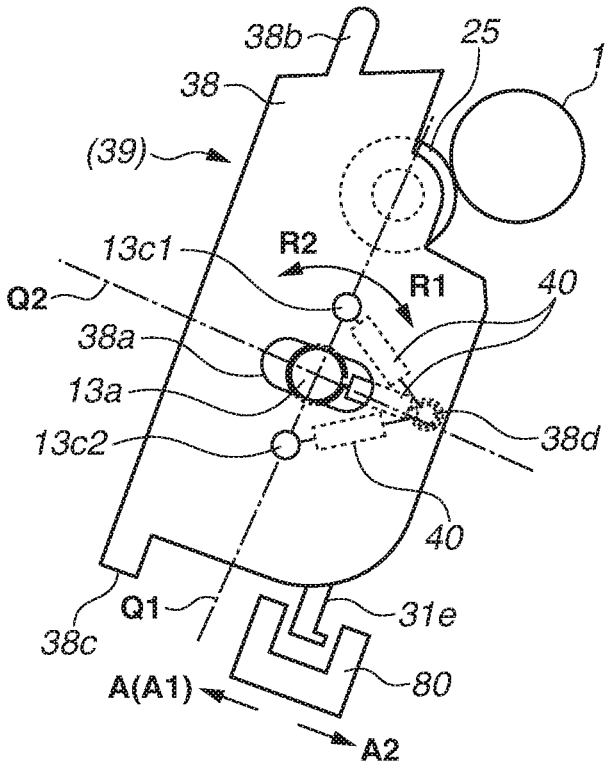
FIG. 19 is a diagram illustrating placement of a biasing member.

FIG. 19 is a diagram illustrating the placement of the tension spring 40 as a biasing member. Similarly to FIG. 17, FIG. 19 is a diagram illustrating the developing cartridge 4 as viewed from the axis direction of the developing roller 25. On the far side of the plane of the paper, the developing unit 39 is located. On the near side of the plane of the paper, the end supporting member 38 is located. For example, as illustrated in FIG. 19, a protruding portion 13*c*1 or 13*c*2 may be provided as a part of the developing unit 39. Then, the tension spring 40 may be placed between the spring fixing boss 38*d* and the protruding portion 13*c*1. Further, the tension spring 40 may be placed between the spring fixing boss 38*d* and the protruding portion 13*c*2. Also in this configuration, the boss 13*a* can be biased in a direction intersecting (desirably a direction orthogonal to) the axis of the developing roller 25. Then, the boss 13*a* can approach the center of the photosensitive drum 1 in the direction intersecting (desirably a direction orthogonal to) the axis of the developing roller 25. Thus, it is possible to stably cause the developing roller 25 to abut the photosensitive drum 1.

On the other hand, in the configuration in which the tension spring 40 directly biases the boss 13*a*, the tension spring 40 hardly generates a force (a moment) for rotating the developing unit 39. Thus, when the developing roller 25 is caused to abut the photosensitive drum 1, it is less likely that a large load is applied to the unit biasing member 80. For example, in a case where the tension spring 40 is hooked to the protruding portion 13*c*2, a force is applied in a direction opposite to the motion of the developing roller 25 abutting the photosensitive drum 1. Further, in a case where the tension spring 40 is hooked to the protruding portion 13*c*1, a force is applied in a direction opposite to the motion of the developing roller 25 separating from the photosensitive drum 1. Thus, the boss 13*a* is directly biased, so that it is less likely that a large load is applied to the unit biasing member 80.

Further, suppose that the tension spring 40 is hooked to the protruding portion 13*c*1, and the developing unit 39 pivots in a direction R1 in FIG. 19 so that the developing roller 25 abuts the photosensitive drum 1. As a result, the protruding portion 13*c*1 also pivots in the direction R1 in FIG. 19. Meanwhile, the spring fixing boss 38*d* is provided in the end supporting member 38. As described above, the end supporting member 38 is fixed to the image forming apparatus. Thus, if the developing unit 39 pivots in the direction R1 in FIG. 19, the distance between the protruding portion 13*c*1 and the spring fixing boss 38*d* shortens. As a result, the force of the tension spring 40 pulling the protruding portion 13*c*1 decreases. Thus, it is necessary to strengthen the force of the tension spring 40.

On the other hand, in the configuration in which the boss 13*a* is directly biased, the distance between the boss 13*a* and the spring fixing boss 38*d* does not change even if the developing unit 39 pivots. Thus, the force of the tension spring 40 pulling the boss 13*a* is less likely to decrease.

That is, although the tension spring 40 may bias the developing unit 39, it is desirable that the tension spring 40 bias the boss 13*a*.

To sum up, in the present exemplary embodiment, among the developing unit 39 and the end supporting member 38, the tension spring 40 is provided in the end supporting member 38. The tension spring 40 is a biasing member for, among the developing unit 39 and the end supporting member 38, biasing the developing unit 39 in a direction intersecting the axis direction of the developing roller 25.

Figure 10:
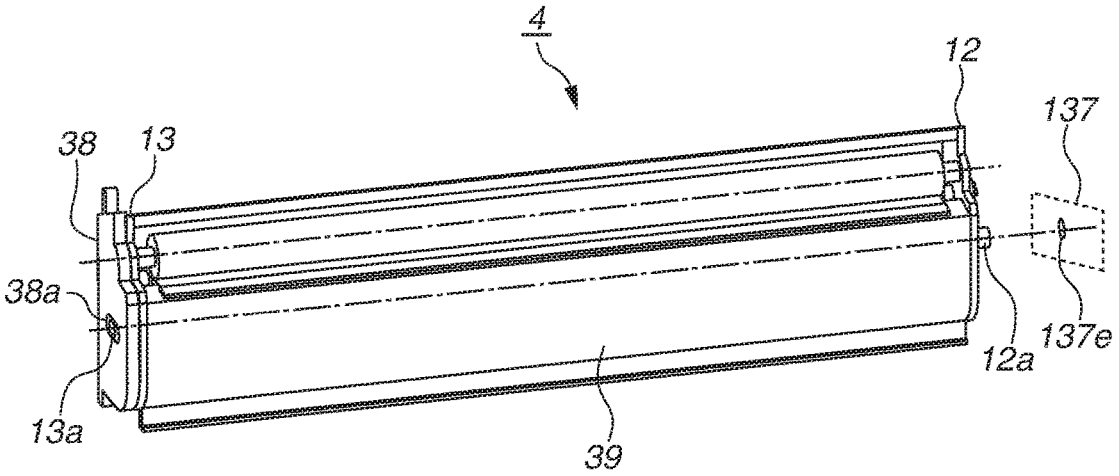
FIG. 10 is a diagram illustrating a configuration in which an other-end supporting member is omitted from the developing device according to the first exemplary embodiment.

In the present exemplary embodiment, the end supporting member 38 and the other-end supporting member 37 are provided at the ends of the developing unit 39. The present invention, however, is not limited to this configuration. For example, as illustrated in FIG. 10, the other-end supporting member 37 may be omitted. That is, for an end portion of the developing unit 39 on the other end side in the axis direction of the developing roller 25 (an end portion on the opposite side of the end portion for which the end supporting member 38 is provided), an apparatus-side supporting portion 137 is provided, which pivotably supports the developing unit 39. The apparatus-side supporting portion 137 is fixedly provided on the far side of the apparatus main body 100. A hole 137*a* (a positioning hole), which is equivalent to the second hole 37*a* according to the present exemplary embodiment, may be provided in the apparatus-side supporting portion 137 such that the boss 12*a* is a supported portion (a positioning shaft). In such a case, the boss 12*a* is a positioning portion pivotably supported by the hole 137*a* and also restrained by the hole 137*a* from moving in a direction intersecting the axis of the developing roller 25.

In this case, the boss 12*a* is attachable to and detachable from the hole 137*a*, and the developing cartridge 4 is pivotably supported by the hole 137*a* through the boss 12*a*. The end supporting member 38 is independent of the apparatus-side supporting portion 137 and therefore is pivotable independently of the apparatus-side supporting portion 137 and relative to the developing cartridge 4. The function of the apparatus-side supporting portion 137 is similar to that of the other-end supporting member 37 in the state where the developing cartridge 4 is attached to the apparatus main body 100, and therefore is not described here.

The apparatus-side supporting portion 137 may be configured to be fixedly provided in a part of a portion obtained by extending a wall surface of the drum cartridge 9 on the far side.

Further, in the present exemplary embodiment, as positioning portions of the developing unit 39, the second hole 37*a* is provided in the other-end supporting member 37, and the boss 12*a* is provided in the developing unit 39. The present invention, however, is not limited to this configuration. That is, a hole equivalent to the second hole 37*a* (a positioning hole) according to the present exemplary embodiment may be provided in either one of the developing unit 39 and the other-end supporting member 37. In this case, a positioning shaft equivalent to the boss 12*a* according to the present exemplary embodiment may be placed in the other of the developing unit 39 and the other-end supporting member 37. Further, in the configuration in which the other-end supporting member 37 is omitted, a positioning shaft equivalent to the boss 12*a* may be provided in either one of the developing unit 39 and the apparatus-side supporting portion 137, and a hole equivalent to the second hole 37*a* may be provided in the other of the developing unit 39 and the apparatus-side supporting portion 137.

Next, with reference to FIGS. 11A, 11B, 12, and 13, the configuration of a developing cartridge 4 according to a second exemplary embodiment of the present invention is described. In the present exemplary embodiment, components different from those of the first exemplary embodiment are particularly described, and basically, components similar to those of the first exemplary embodiment are not described here.

Figure 12:
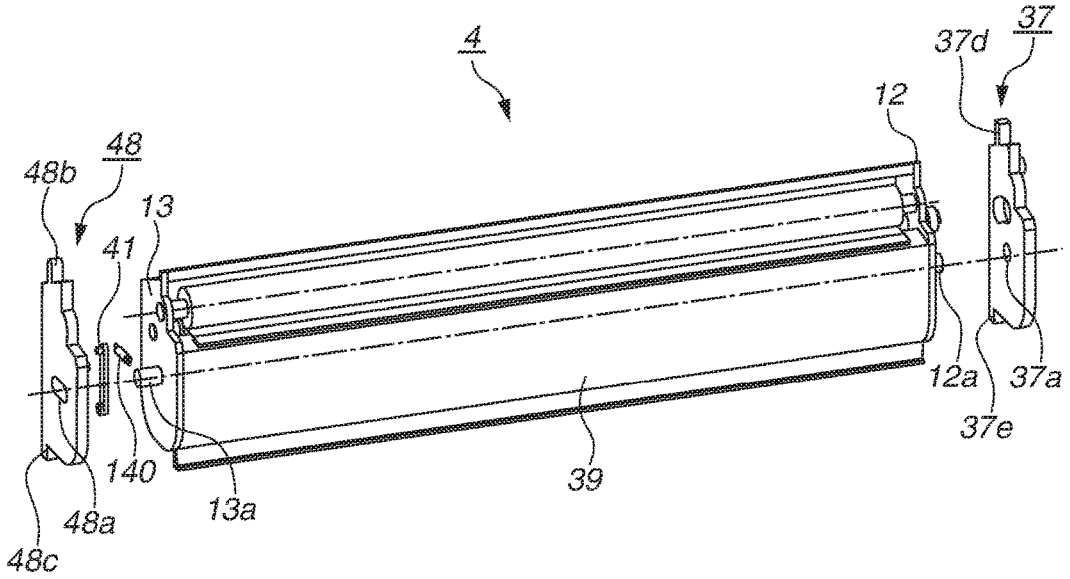
FIG. 12 is a diagram illustrating the developing device according to the second exemplary embodiment.
Figure 13:
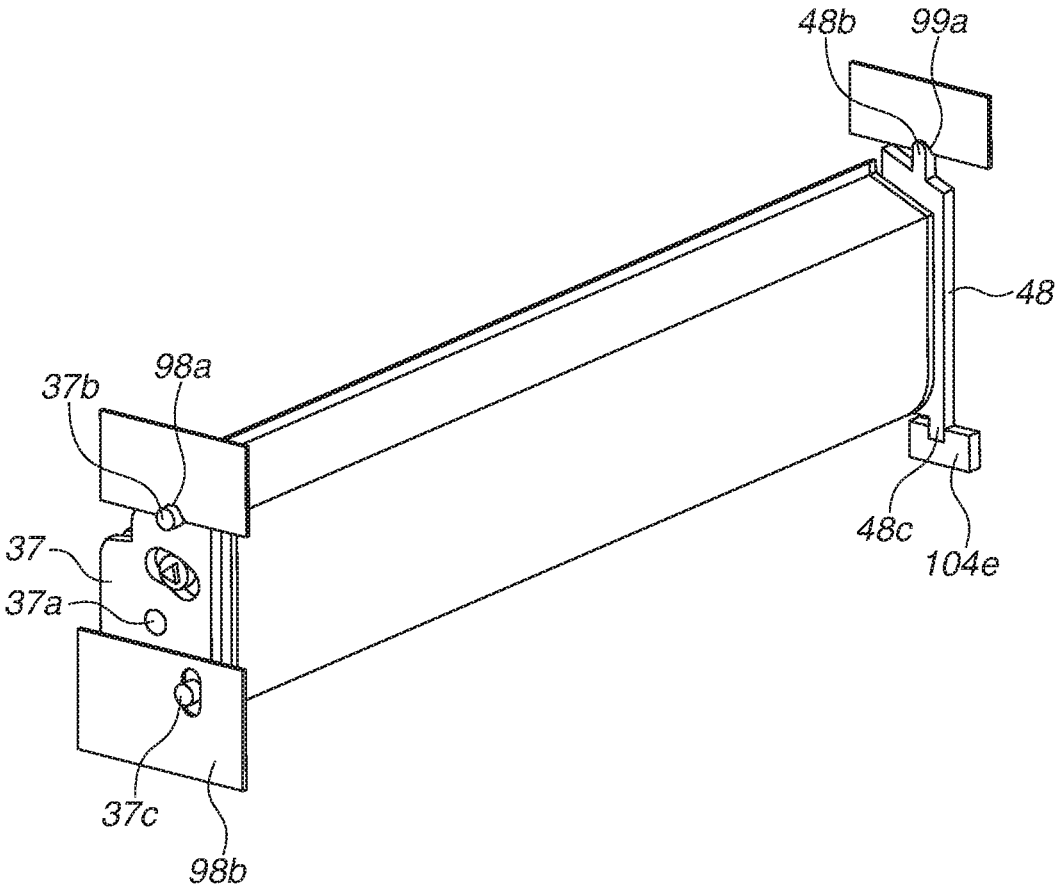
FIG. 13 is a diagram illustrating a state where the developing device according to the second exemplary embodiment is positioned relative to a main body of an image forming apparatus.

As illustrated in FIG. 12, on one end side of a developing unit 39 in the axis direction of a developing roller 25, an end supporting member 48 (which corresponds to the end supporting member 38 in the first exemplary embodiment) is provided. In the end supporting member 48, a first hole 48*a* is provided, which is engaged with a boss 13*a*, which is provided in the developing unit 39. The first hole 48*a* is similar to the first hole 38*a* in the first exemplary embodiment and pivotably supports the boss 13*a*. Further, in the end supporting member 48, a first engaged portion 48*b* and a second engaged portion 48*c* are provided. Similarly to the first exemplary embodiment, after the insertion of the developing cartridge 4 into the apparatus main body 100 is completed, the first engaged portion 48*b* and the second engaged portion 48*c* are engaged with a first main body engagement portion 99*a* and a second main body engagement portion 104*e*, respectively, which are provided in the apparatus main body 100 (see FIG. 13).

In the present exemplary embodiment, as biasing portions for biasing the boss 13*a*, a press lever 41 is used as a press member, and a tension spring 140 is used as a lever biasing member for biasing the press lever 41 toward the boss 13*a*.

Figure 11A:
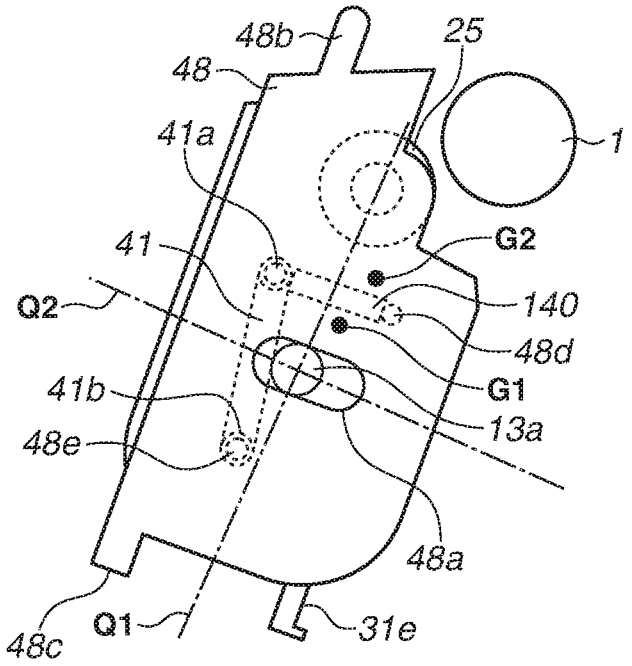
FIG. 11A is a diagram illustrating a developing device according to a second exemplary embodiment when a shift in alignment occurs in a developing unit.

As illustrated in FIG. 11A, the end supporting member 48 includes the press lever 41. In the press lever 41, a lever supported portion 41*b* is formed as a press supported portion, and a spring fixing portion 41*a* is formed as a biasing member locking portion at a position opposed to the lever supported portion 41*b*. Further, the end supporting member 48 includes a lever supporting boss 48*e* as a press supporting portion, and a spring fixing boss 48*d* as a biasing member locked portion. The lever supporting boss 48*e* is provided to be located in a direction opposite, with respect to the center of the first hole 48*a*, to the direction in which the press lever 41 moves the boss 13*a*. The lever supported portion 41*b* is pivotably supported by the lever supporting boss 48*e*. One end of the tension spring 140 is supported by the spring fixing portion 41*a*, and the other end is supported by the spring fixing boss 48*d*. Further, the press lever 41 is configured to bias the boss 13*a* between the lever supported portion 41*b*, which is a position supported by the end supporting member 48, and the spring fixing portion 41*a*, which is a position biased by the tension spring 140.

Similarly to the tension spring 40 described in the first exemplary embodiment, to reduce the influence of a shift in alignment of the developing roller 25, the press lever 41 biases the boss 13*a* in a direction intersecting (desirably a direction orthogonal to) the axis of the developing roller 25. In the present exemplary embodiment, the distance from the lever supported portion 41*b* of the press lever 41 to the spring fixing portion 41*a* is longer than the distance from the lever supported portion 41*b* to the position where the press lever 41 biases the boss 13*a*. Thus, it is possible to reduce the spring pressure of the tension spring 140 for obtaining a force required to bias the boss 13*a*. Therefore, it is possible to stably cause the developing roller 25 to abut the photosensitive drum 1.

Figure 11B:
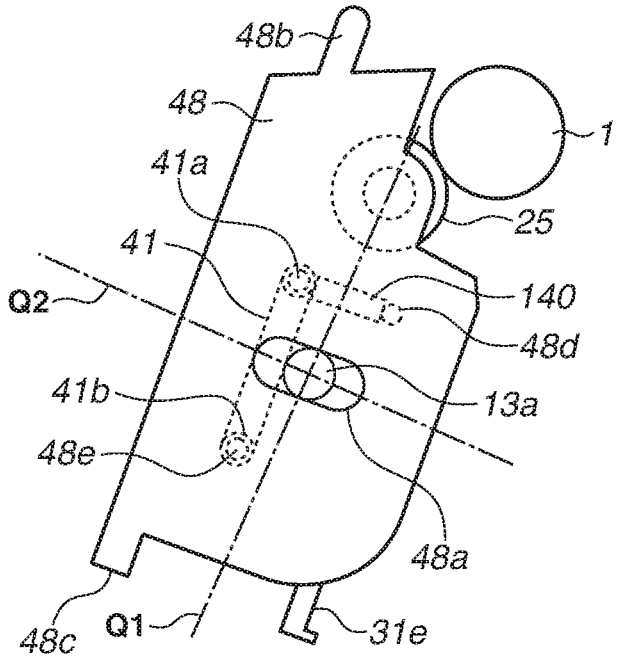
FIG. 11B is a diagram illustrating the developing device when the developing unit is located at a normal position.

That is, as illustrated in FIG. 11B, the boss 13*a* is biased in a direction opposite to the developing unit biasing direction A. That is, in a direction intersecting the axis direction of the developing roller 25, the boss 13*a* is biased in the first hole 48*a* in the direction in which the center of the boss 13*a* approaches the center of the photosensitive drum 1 (the direction in which the distance between the center of the boss 13*a* and the center of the photosensitive drum 1 shortens). In the present exemplary embodiment, this direction is the direction in which the center of the boss 13*a* coincides with the center of the second hole 37*a*. As a result, the center of the boss 13*a* approaches the center of the photosensitive drum 1 so that the distance from the center of the boss 13*a* to the center of the photosensitive drum 1 is the same as the distance from the center of the boss 12*a* to the center of the photosensitive drum 1. That is, the difference between the distance from the center of the boss 13*a* to the center of the photosensitive drum 1 and the distance from the center of the boss 12*a* to the center of the photosensitive drum 1 is smaller than the case where the press lever 41, which is a biasing portion, is not used. The axis of the developing roller 25 comes close to being parallel to the axis of the photosensitive drum 1. That is, the angle between the axis of the developing roller 25 and the axis of the photosensitive drum 1 is smaller than the case where the press lever 41, which is a biasing portion, is not used. Thus, it is possible to stably cause the developing roller 25 to abut the photosensitive drum 1.

Although it is desirable that the distance from the center of the boss 13*a* to the center of the photosensitive drum 1 be the same as the distance from the center of the boss 12*a* to the center of the photosensitive drum 1, these distances do not need to be exactly the same. Further, although it is desirable that the axis of the developing roller 25 be parallel to the axis of the photosensitive drum 1, these axes do not need to be exactly parallel.

Further, similarly to the first exemplary embodiment, although the press lever 41 may bias the developing unit 39, it is desirable that the press lever 41 bias the boss 13*a*.

To sum up, in the present exemplary embodiment, among the developing unit 39 and the end supporting member 48, the press lever 41 and the tension spring 140 are provided in the end supporting member 48. Then, the press lever 41 and the tension spring 140 are biasing members for, among the developing unit 39 and the end supporting member 48, biasing the developing unit 39 in a direction intersecting the axis direction of the developing roller 25.

Figure 14A:
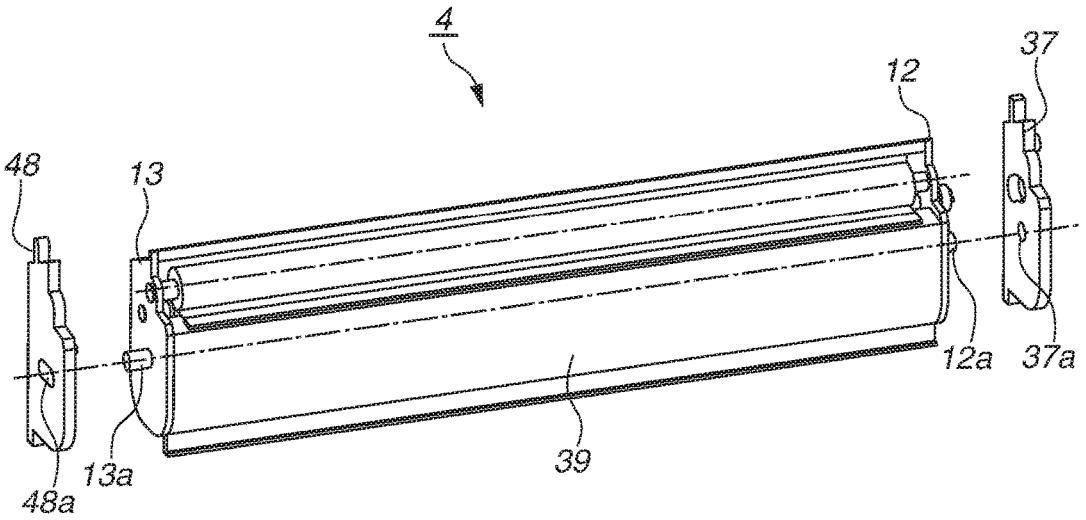
FIGS. 14A and 14B are diagrams illustrating assembly of the developing device according to the second exemplary embodiment.
Figure 14B:
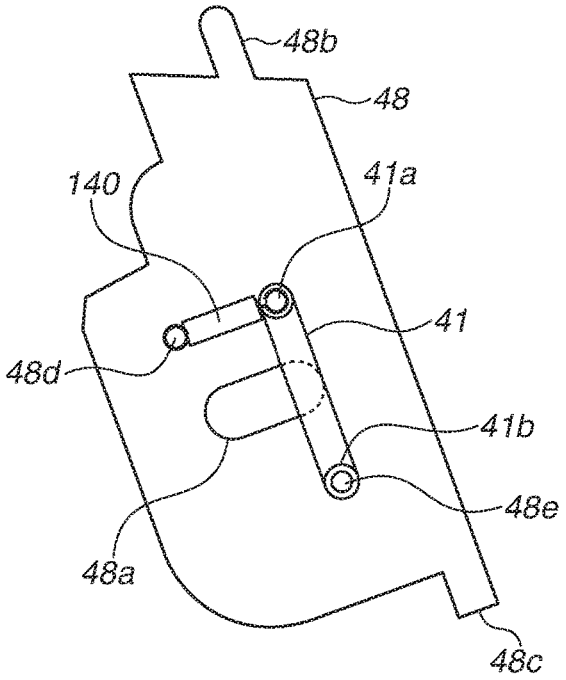

With reference to FIGS. 14A and 14B, a description is given of a method for assembling the developing cartridge 4 described in the present exemplary embodiment.

First, the developing frame member 31 is filled with toner, and the toner supply roller 34 and the developing roller 25 are assembled. The developing unit 39 is thus assembled (a first step).

Next, in the state where the press lever 41 is attached to the lever supporting boss 48*e* in advance, and the tension spring 140 is further attached to the spring fixing portion 41*a* and the spring fixing boss 48*d* in advance, the end supporting member 48 is attached to the developing unit 39 subjected to the first step (a second step).

In this manner, the developing cartridge 4 is assembled. In a case where the other-end supporting member 37 is used, the other-end supporting member 37 may be attached to the developing unit 39 in another step.

According to this assembly method, after the end supporting member 48 is assembled to the developing unit 39, it is not necessary to assemble the tension spring 140. Thus, it is possible to improve the ease of assembly of the developing cartridge 4.

Next, the configuration of a developing cartridge 4 according to a third exemplary embodiment of the present invention is described. In the present exemplary embodiment, components different from those of the first and second exemplary embodiments are particularly described, and basically, components similar to those of the first and second exemplary embodiments are not described here.

In the first and second exemplary embodiments, the developing unit 39 includes the boss 13*a*. The first holes 38*a* and 48*a* are included in the end supporting members 38 and 48, respectively. However, a first shaft (which is equivalent to the boss 13*a*) as a supporting shaft may be provided in either one of the developing unit and the end supporting member. Further, a first hole to be engaged with the first shaft as a supporting shaft may be provided in the other of the developing unit and the end supporting member.

Further, as illustrated in the other exemplary embodiments, the boss 12*a* may be provided in either one of the developing unit 39 and the other-end supporting member 37. The second hole 37*a* to be engaged with the boss 12*a* may be provided in the other of the developing unit 39 and the other-end supporting member 37.

Figure 20:
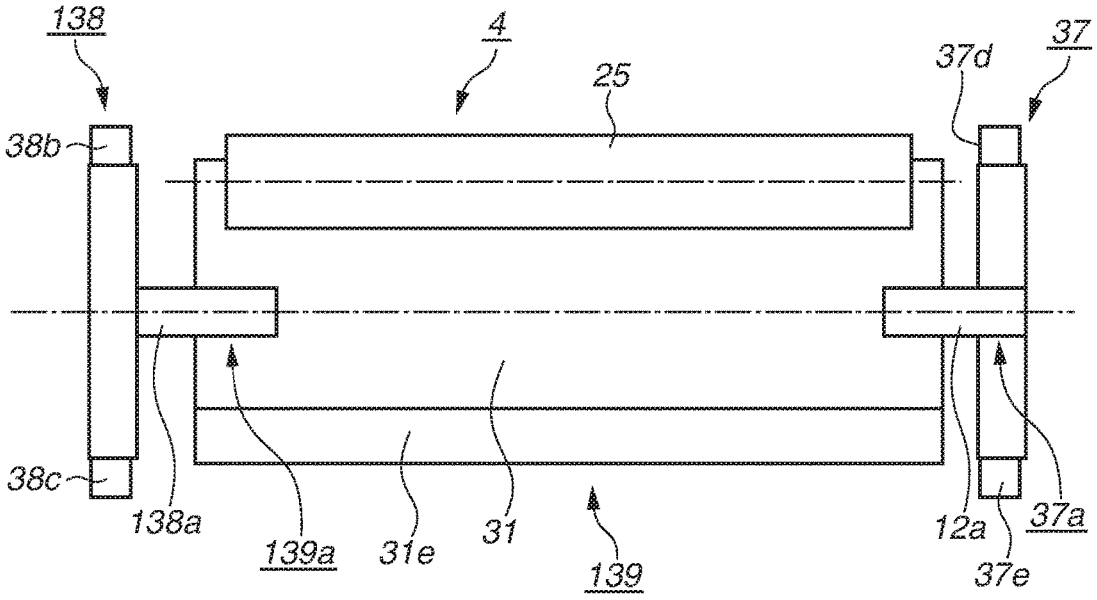
FIG. 20 is a cross-sectional view illustrating a developing device according to a third exemplary embodiment.

With reference to FIG. 20, the configuration of the present exemplary embodiment is described. FIG. 20 is a schematic cross-sectional view illustrating the configuration of the developing cartridge 4 according to the present exemplary embodiment. FIG. 20 is a cross-sectional view of the developing cartridge 4 as viewed from a direction orthogonal to the axis of a developing roller 25.

As illustrated in FIG. 20, in the present exemplary embodiment, in an end supporting member 138 (which is equivalent to the end supporting members 38 and 48 in the first and second exemplary embodiments), a boss 138*a* (which is equivalent to the boss 13*a* in the first and second exemplary embodiments) is provided as a supporting shaft (a first shaft). Further, in a developing unit 139, a first hole 139*a* (which is equivalent to the first hole 38*a* in the first and second exemplary embodiments) is provided as a supporting hole. Further, as illustrated in the other exemplary embodiments, the boss 12*a* is provided in either one of the developing unit 139 and the other-end supporting member 37. The second hole 37*a* to be engaged with the boss 12*a* is provided in the other of the developing unit 139 and the other-end supporting member 37.

Similarly to the other exemplary embodiments, the first hole 139*a* and the boss 138*a* are engaged with each other, and the second hole 37*a* and the boss 12*a* are engaged with each other. As will be described below, the first hole 139*a* is allowed to move relative to the boss 138*a* in a direction intersecting the axis direction of the developing roller 25. Consequently, the developing unit 139 is pivotably supported by the end supporting member 138 and allowed to move in the direction intersecting the axis direction of the developing roller 25. The second hole 37*a* restrains the boss 12*a* from moving in the direction intersecting the axis direction of the developing roller 25. Consequently, the developing unit 139 is pivotably supported by the other-end supporting member 37 and restrained from moving in the direction intersecting the axis direction of the developing roller 25. Thus, similarly to the first exemplary embodiment, the developing unit 139 pivots about the bosses 12*a* and 138*a* such that a line connecting the bosses 12*a* and 138*a* is the pivotal center. Therefore, the developing roller 25 can abut the photosensitive drum 1 and separate from the photosensitive drum 1.

Figure 21A:
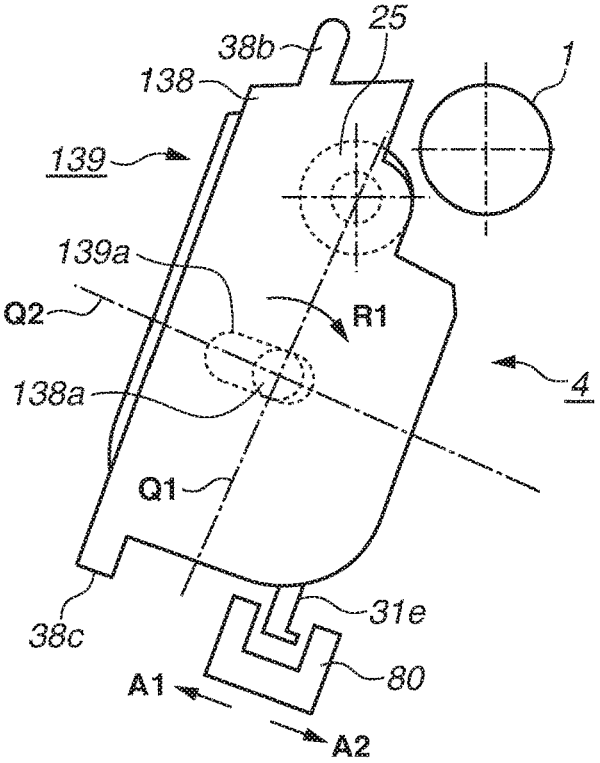
FIG. 21A is a diagram illustrating the developing device according to the third exemplary embodiment when a shift in alignment occurs in a developing unit.
Figure 21B:
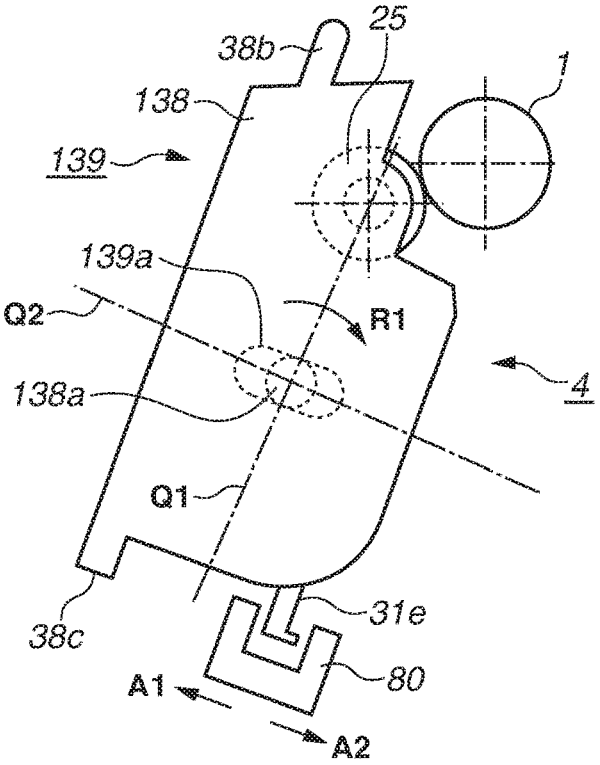
FIG. 21B is a diagram illustrating the developing device when the developing unit is located at a normal position.

FIGS. 21A and 21B are diagrams illustrating the developing cartridge 4 according to the present exemplary embodiment as viewed from the axis direction of the developing roller 25.

Similarly to the first exemplary embodiment, the end supporting member 138 and the other-end supporting member 37 are each pivotable independently of the developing unit 139. Further, in the state where the developing cartridge 4 is attached to the image forming apparatus, the end supporting member 138 and the other-end supporting member 37 are positioned relative to the image forming apparatus. Further, the photosensitive drum 1 is also positioned relative to the image forming apparatus through the drum cartridge 9. The biased portion 31*e* of the developing frame member 31 is biased in a developing unit biasing direction A1 by the unit biasing member 80 of the apparatus main body 100. Then, the developing unit 139 pivots in the direction of an arrow R1, and the developing roller 25 abuts the photosensitive drum 1. Similarly to the other exemplary embodiments, if the biased portion 31*e* is biased in a developing unit biasing direction A2, the developing roller 25 separates from the photosensitive drum 1.

Similarly to the first exemplary embodiment, when a straight line Q1 connecting the center of the developing roller 25 and the center of the boss 138*a* and a straight line Q2 orthogonal to the straight line Q1 are drawn through the center of the boss 138*a*, the biased portion 31*e* is placed in an area on the opposite side of the developing roller 25 with respect to the straight line Q2.

If the biased portion 31*e* is biased in the developing unit biasing direction A1, the developing unit 139 pivots, and the developing roller 25 is going to abut the photosensitive drum 1. In this process, in a direction intersecting the axis of the developing roller 25, the first hole 139*a*, which is a long hole, moves in a direction away from the photosensitive drum 1. On the other hand, since the boss 138*a* is provided in the end supporting member 138, the position of the boss 138*a* relative to the photosensitive drum 1 does not change.

Figure 22A:
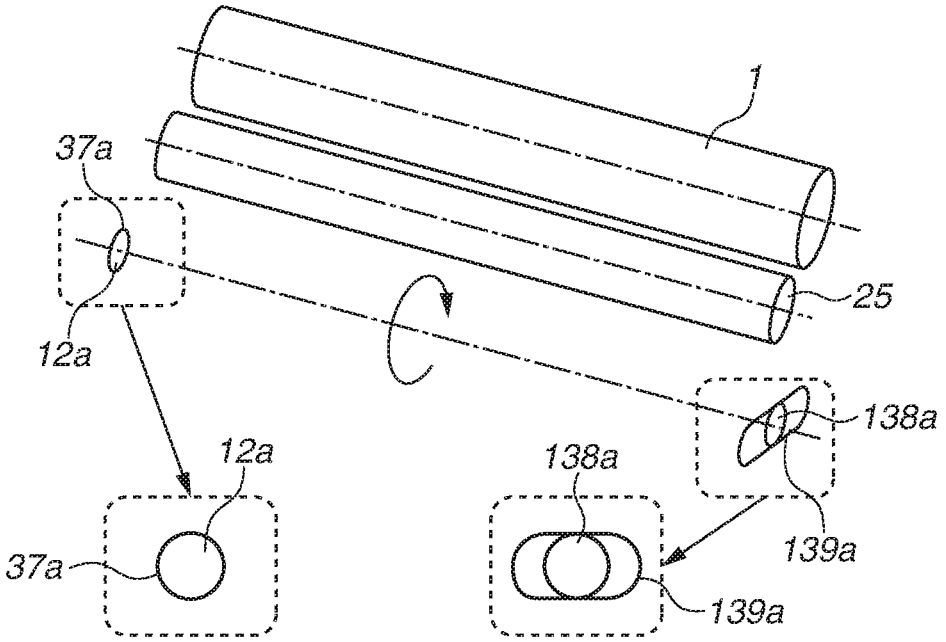
FIGS. 22A and 22B are schematic diagrams illustrating a shift in alignment according to the third exemplary embodiment.
Figure 22B:
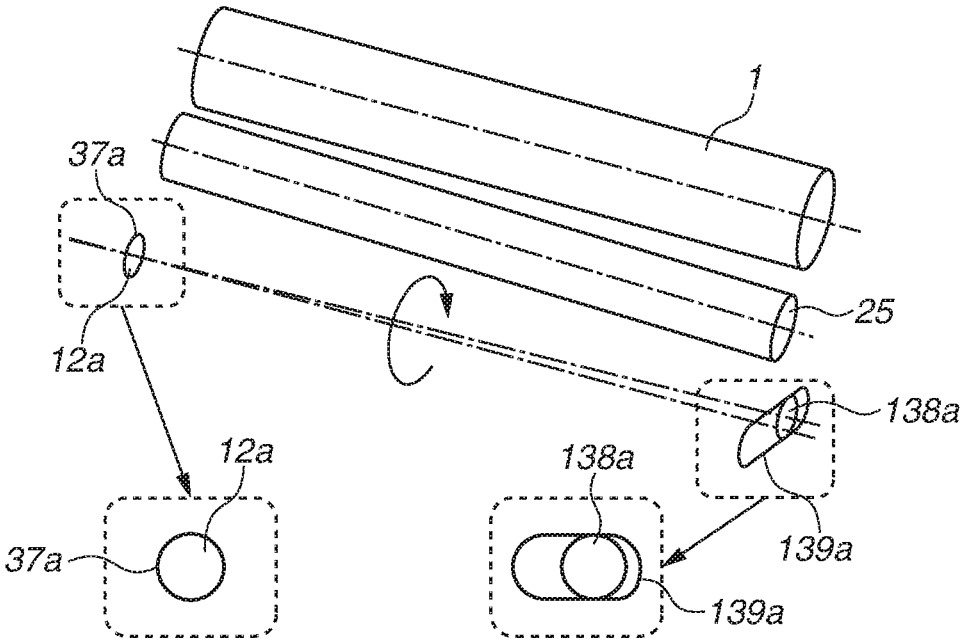

On the other hand, the boss 12*a* and the second hole 37*a*, which is a circular hole, on the opposite side are restrained from moving in the direction intersecting the axis of the developing roller 25. As a result, similarly to the first exemplary embodiment, the developing cartridge 4 is in the state where the axis of the developing roller 25 is oblique relative to the axis of the photosensitive drum 1, i.e., the state where a shift in alignment occurs in the developing unit 139. FIGS. 22A and 22B are, similarly to FIGS. 18A and 18B in the first exemplary embodiment, schematic diagrams illustrating the shift in alignment described above. FIG. 22A illustrates the state where the axis of the developing roller 25 is substantially parallel to the axis of the photosensitive drum 1. FIG. 22B illustrates the state where the axis of the developing roller 25 is not parallel to the axis of the photosensitive drum 1, i.e., the state where a shift in alignment occurs. As illustrated in FIGS. 22A and 22B, the first hole 139*a*, which is a long hole, moves in a direction away from the photosensitive drum 1 while being engaged with the boss 138*a*. On the other hand, the boss 12*a* and the second hole 37*a*, which is a circular hole, are restrained from moving in a direction intersecting the axis of the developing roller 25. Thus, the developing cartridge 4 is in the state where the axis of the developing roller 25 is not parallel to the axis of the photosensitive drum 1. In this state where a shift in alignment occurs, the developing roller 25 may not be able to abut the photosensitive drum 1.

Figure 23A:
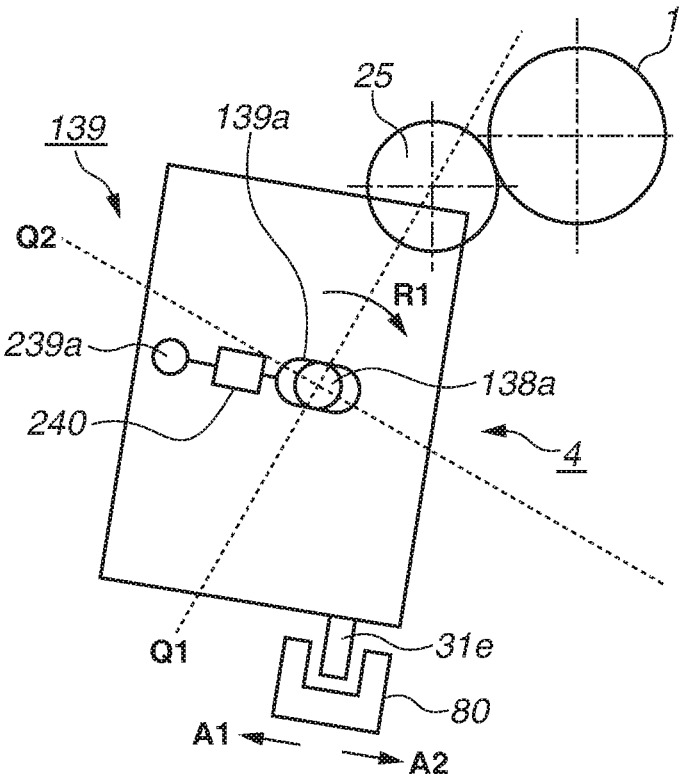
FIGS. 23A and 23B are schematic diagrams illustrating a biasing member according to the third exemplary embodiment.

In response, as illustrated in FIG. 23A, the developing cartridge 4 includes a tension spring 240, which is an elastic member as a biasing portion, in the developing unit 139. Further, the developing unit 139 includes a spring fixing boss 239*d*, which is an elastic member supporting portion for supporting the tension spring 240. One end of the tension spring 240 is supported by the spring fixing boss 239*d*, which is an elastic member supporting portion of the developing unit 139, and the other end is supported by the boss 138*a* of the end supporting member 138.

The tension spring 240 biases the boss 138*a* in a direction intersecting (desirably a direction orthogonal to) the axis of the developing roller 25. That is, as illustrated in FIG. 23A, the boss 138*a* is biased by the tension spring 240 so that the first hole 139*a* moves in a direction opposite to the developing unit biasing direction A1.

In the direction intersecting the axis direction of the developing roller 25, the tension spring 240 biases the boss 138*a* so that the center of the first hole 139*a* moves in a direction opposite to the developing unit biasing direction A1. Then, the center of the first hole 139*a* moves in the direction in which the center of the first hole 139*a* approaches the center of the photosensitive drum 1 (the direction in which the distance between the center of the first hole 139*a* and the center of the photosensitive drum 1 shortens). In the present exemplary embodiment, this direction is the direction in which the center of the first hole 139*a* coincides with the center of the second hole 37*a* or the boss 12*a*. As a result, the center of the first hole 139*a* approaches the center of the photosensitive drum 1 so that the distance from the center of the first hole 139*a* to the center of the photosensitive drum 1 is the same as the distance from the center of the second hole 37*a* or the boss 12*a* to the center of the photosensitive drum 1. That is, the difference between the distance from the center of the first hole 139*a* to the center of the photosensitive drum 1 and the distance from the center of the second hole 37*a* or the boss 12*a* to the center of the photosensitive drum 1 is smaller than the case where the tension spring 240, which is a biasing portion, is not used. Then, the axis of the developing roller 25 comes close to being parallel to the axis of the photosensitive drum 1. That is, the angle between the axis of the developing roller 25 and the axis of the photosensitive drum 1 is smaller than the case where the tension spring 240, which is a biasing portion, is not used. Thus, it is possible to stably cause the developing roller 25 to abut the photosensitive drum 1.

Although it is desirable that the distance from the center of the first hole 139*a* to the center of the photosensitive drum 1 be the same as the distance from the center of the second hole 37*a* or the boss 12*a* to the center of the photosensitive drum 1, these distances do not need to be exactly the same. Further, although it is desirable that the axis of the developing roller 25 be parallel to the axis of the photosensitive drum 1, these axes do not need to be exactly parallel.

Further, similarly to the first exemplary embodiment, although the tension spring 240 may bias the end supporting member 138, it is desirable that the tension spring 240 bias the boss 138*a*. In the above configuration, among the developing unit 139 and the end supporting member 138, the tension spring 240 is provided in the developing unit 139. Thus, the tension spring 240 is a biasing member for, among the developing unit 139 and the end supporting member 138, biasing the end supporting member 138 in a direction intersecting the axis direction of the developing roller 25.

Figure 23B:
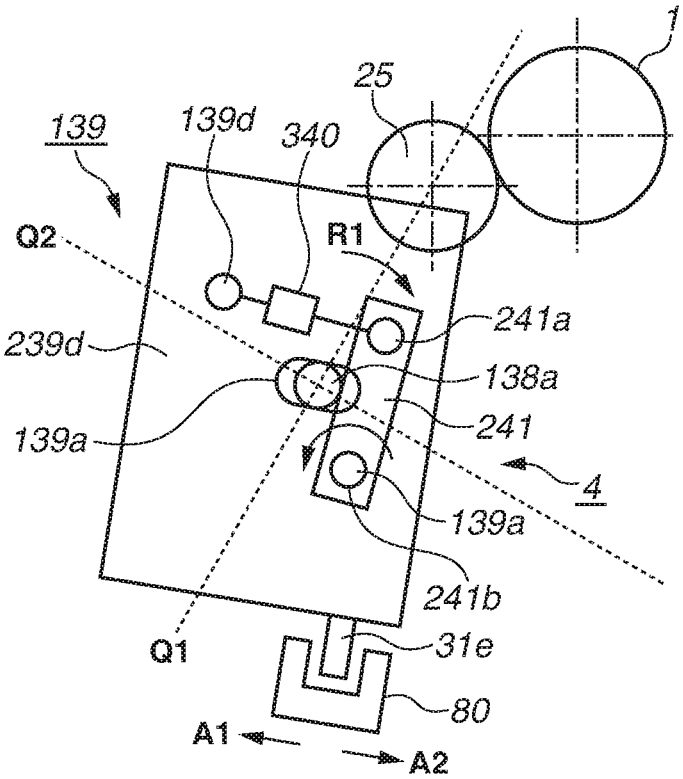

Further, in another configuration, as illustrated in FIG. 23B, instead of the tension spring 240, a press lever and a lever biasing member can also be used as biasing members as described in the second exemplary embodiment.

In this configuration, as biasing portions for biasing the boss 138*a*, a press lever 241 and a tension spring 340, which biases the press lever 241 toward the boss 138*a*, are used.

The developing unit 139 includes the press lever 241. The press lever 241 includes a lever supported portion 241*b* as a press supported portion, and a spring fixing portion 241*a* as a biasing member locking portion at a position opposed to the lever supported portion 241*b*. Further, the developing unit 139 includes a lever supporting boss 139*e* as a press supporting portion, and a spring fixing boss 139*d* as a biasing member locked portion. The lever supporting boss 139*e* is provided to be located in a direction opposite, with respect to the center of the boss 138*a*, to the direction in which the press lever 241 presses the boss 138*a*, and the developing unit 139 moves. The lever supported portion 241*b* is pivotably supported by the lever supporting boss 139*e*. One end of the tension spring 340 is supported by the spring fixing portion 241*a*, and the other end is supported by the spring fixing boss 139*d*. Further, the press lever 241 is configured to bias the boss 138*a* between the lever supported portion 241*b*, which is in a position supported by the developing unit 139, and the spring fixing portion 241*a*, which is in a position biased by the tension spring 340.

Similarly to the tension spring 240, to reduce the influence of a shift in alignment of the developing roller 25, the press lever 241 biases the boss 138*a* in a direction intersecting (desirably a direction orthogonal to) the axis of the developing roller 25.

In the direction intersecting the axis direction of the developing roller 25, the press lever 241 and the tension spring 340 bias the boss 138*a* so that the center of the first hole 139*a* moves in a direction opposite to the developing unit biasing direction A1. In the direction intersecting the axis direction of the developing roller 25, the center of the first hole 139*a* moves by the press lever 241 and the tension spring 340 in the direction in which the center of the first hole 139*a* approaches the center of the photosensitive drum 1 (the direction in which the distance between the center of the first hole 139*a* and the center of the photosensitive drum 1 shortens). In the present exemplary embodiment, this direction is the direction in which the center of the first hole 139*a* coincides with the center of the second hole 37*a* or the boss 12*a*. As a result, the center of the first hole 139*a* approaches the center of the photosensitive drum 1 so that the distance from the center of the first hole 139*a* to the center of the photosensitive drum 1 is the same as the distance from the center of the second hole 37*a* or the boss 12*a* to the center of the photosensitive drum 1. That is, the difference between the distance from the center of the first hole 139*a* to the center of the photosensitive drum 1 and the distance from the center of the second hole 37*a* or the boss 12*a* to the center of the photosensitive drum 1 is smaller than the case where the press lever 241, which is a biasing portion, is not used. Then, the axis of the developing roller 25 comes close to being parallel to the axis of the photosensitive drum 1. That is, the angle between the axis of the developing roller 25 and the axis of the photosensitive drum 1 is smaller than the case where the press lever 241 is not used. Thus, it is possible to stably cause the developing roller 25 to abut the photosensitive drum 1.

Although it is desirable that the distance from the center of the first hole 139*a* to the center of the photosensitive drum 1 be the same as the distance from the center of the second hole 37*a* or the boss 12*a* to the center of the photosensitive drum 1, these distances do not need to be exactly the same. Further, although it is desirable that the axis of the developing roller 25 be parallel to the axis of the photosensitive drum 1, these axes do not need to be exactly parallel.

Further, similarly to the second exemplary embodiment, although the press lever 241 may bias the end supporting member 138, it is desirable that the press lever 241 bias the boss 138*a*. In the above configuration, among the developing unit 139 and the end supporting member 138, the press lever 241 and the tension spring 340 are provided in the developing unit 139. The press lever 241 and the tension spring 340 are biasing members for, among the developing unit 139 and the end supporting member 138, biasing the end supporting member 138 in a direction intersecting the axis direction of the developing roller 25.

As described above, according to the present invention, it is possible to improve the stability of the abutment of a developing roller as a developer bearing member to a photosensitive drum as an image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-056987, filed Mar. 22, 2016, and No.

2017-031355, filed Feb. 22, 2017 which are hereby incorporated by reference herein in their entirety.

What is claimed is:

1. A developing device comprising:

a developing unit including a developer bearing member and a developing frame member, the developing frame member being configured to support the developer bearing member;

an end supporting member configured to pivotably support the developing unit on one end side in an axis direction of the developer bearing member;

an other-end supporting member configured to pivotably support the developing unit on the other end side in the axis direction;

a first shaft provided on an outside surface of the developing frame member in the developing unit;

a second shaft provided on either one of the developing unit and the other-end supporting member;

a first hole provided in the end supporting member, the first hole being configured to support the first shaft so that the developing unit pivots about the first shaft and the second shaft and also being configured to allow the first shaft to move in a direction intersecting the axis direction;

a second hole provided in the other of the developing unit and the other-end supporting member, the second hole being configured to support the second shaft so that the developing unit pivots about the first shaft and the second shaft and also being configured to restrain the second shaft from moving in the direction intersecting the axis direction; and a biasing member configured to bias the first shaft in the direction intersecting the axis direction, wherein the developing device is configured to be detachably mountable to an image forming apparatus independent of any image bearing member.

2. The developing device according to claim 1, wherein in the direction intersecting the axis direction, the biasing member biases the first shaft so that a center of the first shaft approaches a center of an image bearing member.

3. The developing device according to claim 1, further comprising a force reception portion provided in the developing unit and configured to be biased so that the developer bearing member abuts an image bearing member.

4. The developing device according to claim 3, wherein, when the force reception portion is biased, the first shaft moves in a direction away from a center of the image bearing member.

5. The developing device according to claim 3, wherein the force reception portion is provided in an area on an opposite side of the developer bearing member with respect to a first straight line that is orthogonal to a second straight line connecting a center of the developer bearing member and a center of the first shaft and passes through the center of the first shaft.

6. The developing device according to claim 5, wherein the force reception portion is biased by a force imparting portion provided in an image forming apparatus.

7. The developing device according to claim 1, wherein the biasing member includes:

a lever member rotatably supported by the end supporting member; and a lever biasing member configured to bias the lever member toward the first shaft.

8. The developing device according to claim 7, wherein the lever member biases the first shaft between a position biased by the lever biasing member and a position supported by the end supporting member.

9. The developing device according to claim 1, wherein the first hole is a long hole including a first regulation portion configured to regulate a position of the first shaft in a diameter direction of the first shaft, and a second regulation portion configured to regulate a position of the first shaft in a direction intersecting a direction in which the first regulation portion regulates the position of the first shaft in the diameter direction of the first shaft, the second regulation portion being larger than the first regulation portion.

10. The developing device according to claim 1, wherein the end supporting member and the other-end supporting member are independently pivotable to the developing unit.

11. The developing device according to claim 1, wherein the developing device is attachable to and detachable from an apparatus main body in the axis direction.

12. The developing device according to claim 1, wherein the developing device is attachable to and detachable from an image forming apparatus including an image bearing member that the developer bearing member abuts.

13. An image forming apparatus comprising:

the developing device according to claim 1; and an image bearing member.

14. A developing device comprising:

a developing unit including a developer bearing member and a developing frame member, the developing frame member being configured to support the developer bearing member;

an end supporting member configured to pivotably support the developing unit on one end side in an axis direction of the developer bearing member;

an other-end supporting member configured to pivotably support the developing unit on the other end side in the axis direction;

a first shaft provided on an outside surface of the developing frame member in the developing unit;

a second shaft provided on either one of the developing unit and the other-end supporting member;

a first hole provided in the end supporting member, the first hole being configured to support the first shaft so that the developing unit pivots about the first shaft and the second shaft and also being configured to allow the first shaft to move in a direction intersecting the axis direction;

a second hole provided in the other of the developing unit and the other-end supporting member, the second hole being configured to support the second shaft so that the developing unit pivots about the first shaft and the second shaft and also being configured to restrain the second shaft from moving in the direction intersecting the axis direction; and a biasing member configured to bias the first shaft in the direction intersecting the axis direction wherein the biasing member is an elastic member of which one end is supported by the end supporting member, and the other end is supported by the first shaft.

15. A developing device comprising:

a developing unit including a developer bearing member and a developing frame member, the developing frame member being configured to support the developer bearing member;

an end supporting member configured to pivotably support the developing unit on one end side in an axis direction of the developer bearing member;

an other-end supporting member configured to pivotably support the developing unit on the other end side in the axis direction;

a first shaft provided on the end supporting member;

a second shaft provided on the other-end supporting member;

a first hole provided in the developing frame at one end of the developing unit, the first hole being supported by the first shaft so that the developing unit pivots about the first shaft and the second shaft and also being configured to allow the developing unit to move relative to the first shaft in a direction intersecting the axis direction;

a second hole provided in the developing frame at the other end of the developing unit, the second hole being configured to support the second shaft so that the developing unit pivots about the first shaft and the second shaft and also being configured to restrain the second shaft from moving in the direction intersecting the axis direction; and a biasing member configured to bias the first shaft in the direction intersecting the axis direction, wherein the developing device is configured to be detachably mountable to an image forming apparatus independent of any image bearing member.

16. The developing device according to claim 15, wherein in the direction intersecting the axis direction, the biasing member biases the first shaft so that a center of the first hole approaches a center of an image bearing member.

17. The developing device according to claim 15, further comprising a force reception portion provided in the developing unit and configured to be biased so that the developer bearing member abuts an image bearing member.

18. The developing device according to claim 17, wherein, when the force reception portion is biased, the first hole moves in a direction away from a center of the image bearing member.

19. The developing device according to claim 17, wherein the force reception portion is provided in an area on an opposite side of the developer bearing member with respect to a first straight line that is orthogonal to a second straight line connecting a center of the developer bearing member and a center of the first shaft and passes through the center of the first shaft.

20. A developing device comprising:

a developing unit including a developer bearing member and a developing frame member, the developing frame member being configured to support the developer bearing member;

an end supporting member configured to pivotably support the developing unit on one end side in an axis direction of the developer bearing member;

an other-end supporting member configured to pivotably support the developing unit on the other end side in the axis direction;

a first shaft provided on either one of the developing unit or the end supporting member;

a second shaft provided on either one of the developing unit and the other-end supporting member;

a first hole provided in the other of the developing unit and the end supporting member, the first hole being engaged with the first shaft so that the developing unit pivots about the first shaft and the second shaft and also being configured to allow the developing unit to move in a direction intersecting the axis direction;

a second hole provided in the other of the developing unit or the other-end supporting member, the second hole being engaged with the second shaft so that the developing unit pivots about the first shaft and the second shaft and also being configured to restrain the developing unit from moving in the direction intersecting the axis direction; and a biasing member provided in either one of the developing unit and the end supporting member and configured to bias the other of the developing unit and the end supporting member in the direction intersecting the axis direction, wherein the end supporting member and the other-end supporting member are independently pivotable relative to the developing unit, and wherein the developing device is configured to be detachably mountable to an image forming apparatus independent of any image bearing member.

21. The developing device according to claim 20, wherein the biasing member biases the first shaft.

22. The developing device according to claim 20, further comprising a force reception portion provided in the developing unit and biased so that the developer bearing member abuts an image bearing member.

23. The developing device according to claim 22, wherein the force reception portion is provided in an area on an opposite side of the developer bearing member with respect to a first straight line that is orthogonal to a second straight line connecting a center of the developer bearing member and a center of the first shaft and passes through the center of the first shaft.

* * * * *